US006345672B1

(12) United States Patent
Dietzen

(10) Patent No.: US 6,345,672 B1
(45) **Date of Patent: *Feb. 12, 2002**

(54) METHOD AND APPARATUS FOR HANDLING AND DISPOSAL OF OIL AND GAS WELL DRILL CUTTINGS

(76) Inventor: Gary Dietzen, 110 Stonewood Cir., Lafayette, LA (US) 70508

( * ) Notice: Subject to any disclaimer, the term of this patent is extended or adjusted under 35 U.S.C. 154(b) by 0 days.

This patent is subject to a terminal disclaimer.

(21) Appl. No.: 09/315,218

(22) Filed: May 19, 1999

Related U.S. Application Data

(63) Continuation-in-part of application No. 09/260,948, filed on Mar. 2, 1999, now Pat. No. 6,179,071, which is a continuation-in-part of application No. 09/182,623, filed on Oct. 29, 1998, now Pat. No. 6,179,070, which is a continuation-in-part of application No. 09/071,820, filed on May 1, 1998, now Pat. No. 5,971,084, which is a continuation-in-part of application No. 09/039,178, filed on Mar. 13, 1998, now Pat. No. 5,913,372, which is a continuation-in-part of application No. 08/950,296, filed on Oct. 14, 1997, now Pat. No. 6,009,959, which is a continuation-in-part of application No. 08/813,462, filed on Mar. 10, 1997, now Pat. No. 5,839,521, which is a continuation-in-part of application No. 08/729,872, filed on Oct. 15, 1996, now Pat. No. 5,842,529, which is a continuation-in-part of application No. 08/416,181, filed on Apr. 4, 1995, now Pat. No. 5,564,509, which is a continuation-in-part of application No. 08/197,727, filed on Feb. 17, 1994, now Pat. No. 5,402,857.

(51) Int. Cl.[7] ..... E21B 21/06; B09B 5/00
(52) U.S. Cl. ..... 175/66; 175/206; 175/207
(58) Field of Search ..... 175/66, 206, 207, 175/88; 134/108; 405/128

(56) References Cited

U.S. PATENT DOCUMENTS

| | | | |
|---|---|---|---|
| 1,125,413 | A | 1/1915 | Van Doren |
| 2,803,501 | A | 8/1957 | Kelly |
| 3,400,819 | A | 9/1968 | Burdyn |
| 3,433,312 | A | 3/1969 | Burdyn et al. |
| 3,993,359 | A | 11/1976 | Sweeney |

(List continued on next page.)

FOREIGN PATENT DOCUMENTS

| | | |
|---|---|---|
| EP | 0 005 273 | 5/1979 |
| GB | 2162880 A | 2/1986 |
| GB | 2330600 A | 4/1999 |
| WO | WO 98/16717 | 4/1998 |

OTHER PUBLICATIONS

Alco Pump Company HP Series Brochure.

*Primary Examiner*—Frank Tsay

(57) ABSTRACT

A method and apparatus for removing drill cuttings from an oil and gas well drilling platform provides for the separation of drill cuttings from at least a volume of the well drilling fluid (i.e. drilling mud) on the drilling platform so that the drilling fluids can be recycled into the well bore. The cuttings are then transferred to a cuttings collection receptacle (eg. trough) on the platform. The separated drill cuttings are then suctioned with a first suction line having an intake portion. The suctioned drill cuttings are transmitted to a processing tank (or multiple such tanks) on the platform, each having a tank interior. A vacuum is formed within the processing tank interior with a blower that is in fluid communication with the tank interior via a second vacuum line. The tank is connected to a floating work boat with a discharge flow line. Cuttings are processed within the tank, being chopped or cut into smaller size particles with a pump that is preferably contained within the processing tank. Cuttings are slurrified or liquified in the processing tank, then transmitted from the tank to the work boat via the flow line. Multiple holding tanks can be positioned on the drilling platform for storage of cuttings until a work boat arrives. The work boat can be provided with one or more high capacity work boat holding tanks (for example 100–1000 barrels) for receiving cuttings from the multiple holding tanks on the drilling platform when disposal is desired.

45 Claims, 21 Drawing Sheets

U.S. PATENT DOCUMENTS 4,019,641 A 4/1977 Merz
4,030,558 A 6/1977 Morris
4,565,086 A 1/1986 Orr, Jr.
4,595,422 A 6/1986 Hill et al.
D296,027 S 5/1988 Dietzen
4,793,423 A 12/1988 Knol
4,878,576 A 11/1989 Dietzen
4,942,929 A 7/1990 Malachosky et al.
5,016,717 A 5/1991 Simons et al.
5,109,933 A 5/1992 Jackson
5,132,025 A * 7/1992 Hays ..... 210/758
5,190,085 A 3/1993 Dietzen
D337,809 S 7/1993 Dietzen
5,310,285 A * 5/1994 Northcott ..... 588/250
5,322,393 A 6/1994 Lundquist
5,341,856 A 8/1994 Appenzeller
5,344,570 A 9/1994 McLachlan et al.
5,564,509 A 10/1996 Dietzen
5,662,807 A 9/1997 Angelle
5,734,988 A * 3/1998 Alexander et al. ..... 588/250
5,839,521 A 11/1998 Dietzen
5,842,529 A 12/1998 Dietzen
5,846,440 A 12/1998 Angelle

* cited by examiner

METHOD AND APPARATUS FOR HANDLING AND DISPOSAL OF OIL AND GAS WELL DRILL CUTTINGS

CROSS-REFERENCE TO RELATED APPLICATIONS

This is a continuation-in-part of U.S. patent application Ser. No. 09/260,949, filed Mar. 2, 1999, now U.S. Pat. No. 6,179,071, which is a continuation-in-part of U.S. patent application Ser. No. 09/182,623, filed Oct. 29, 1998, now U.S. Pat. No. 6,179,070, which is a continuation-in-part of U.S. patent application Ser. No. 09/071,820, filed May 1, 1998, now U.S. Pat. No. 5,971,084, which is a continuation-in-part of U.S. patent application Ser. No. 09/039,178, filed Mar. 13, 1998, now U.S. Pat. No. 5,913,572 which is a continuation-in-part of U.S. patent application Ser. No. 08/950,296, filed Oct. 14, 1997, now U.S. Pat. No. 6,009,959, which is a continuation-in-part of U.S. patent application Ser. No. 08/813,462, filed Mar. 10, 1997, now U.S. Pat. No. 5,839,521 which is a continuation-in-part of U.S. patent application Ser. No. 08/729,872, filed Oct. 15, 1996, now U.S. Pat. No. 5,842,509 which is a continuation-in-part of copending U.S. patent application Ser. No. 08/416,181, filed Apr. 4, 1995 (now U.S. Pat. No. 5,564,509) which is a continuation-in-part of U.S. patent application Ser. No. 08/197,727, filed Feb. 17, 1994 (now U.S. Pat. No. 5,402,857), each of which is hereby incorporated herein by reference.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to oil and gas well drilling and more particularly to the handling of cuttings that are generated during oil and gas well drilling activity. Even more particularly, the present invention relates to an improved method and apparatus for handling cuttings that are generated during oil and gas well drilling and in oil and gas exploration. Tanks are provided on an oil and gas well drilling platform and on a work boat positioned next to the platform. Both the platform and work boat have vacuum units that help transfer cuttings from the platform to the work boat. Processing units can be used to slurrify or liquify the cuttings, either on the platform or on the boat. The liquified or slurrified cuttings can be treated to obtain a desired particle size and/or viscosity.

2. General Background of the Invention

In the drilling of oil and gas wells, a drill bit is used to dig many thousands of feet into the earth's crust. Oil rigs typically employ a derrick that extends above the well drilling platform and which can support joint after joint of drill pipe connected end to end during the drilling operation. As the drill bit is pushed farther and farther into the earth, additional pipe joints are added to the ever lengthening "string" or "drill string". The drill pipe or drill string thus comprises a plurality of joints of pipe, each of which has an internal, longitudinally extending bore for carrying fluid drilling mud from the well drilling platform through the drill string and to a drill bit supported at the lower or distal end of the drill string.

Drilling mud lubricates the drill bit and carries away well cuttings generated by the drill bit as it digs deeper. The cuttings are carried in a return flow stream of drilling mud through the well annulus and back to the well drilling platform at the earth's surface. When the drilling mud reaches the surface, it is contaminated with small pieces of shale and rock which are known in the industry as well cuttings or drill cuttings.

Well cuttings have in-the past been separated from the reusable drilling mud with commercially available separators that are known as "shale shakers". Other solids separators include mud cleaners and centrifuge. Some shale shakers are designed to filter coarse material from the drilling mud while other shale shakers are designed to remove finer particles from the well drilling mud. After separating well cuttings therefrom, the drilling mud is returned to a mud pit where it can be supplemented and/or treated prior to transmission back into the well bore via the drill string and to the drill bit to repeat the process.

The disposal of the separated shale and cuttings is a complex environmental problem. Drill cuttings contain not only the mud product which would contaminate the surrounding environment, but also can contain oil that is particularly hazardous to the environment, especially when drilling in a marine environment.

In the Gulf of Mexico for example, there are hundreds of drilling platforms that drill for oil and gas by drilling into the subsea floor. These drilling platforms can be in many hundreds of feet of water. In such a marine environment, the water is typically crystal clear and filled with marine life that cannot tolerate the disposal of drill cuttings waste such as that containing a combination of shale, drilling mud, oil, and the like. Therefore, there is a need for a simple, yet workable solution to the problem of disposing of oil and gas well cuttings in an offshore marine environment and in other fragile environments where oil and gas well drilling occurs.

Traditional methods of cuttings disposal have been dumping, bucket transport, cumbersome conveyor belts, screw conveyors, and washing techniques that require large amounts of water. Adding water creates additional problems of added volume and bulk, messiness, and transport problems. Installing conveyors requires major modification to the rig area and involves many installation hours and very high cost.

Patents that relate generally to well cuttings and/or disposal of well cuttings include U.S. Pat. No. 4,255,269 issued to Timmer and entitled "Method and Apparatus for Adapting the Composition of a Drilling Fluid for Use in Making a Hole in the Earth by Rotary Drilling". Another patent that relates to drilling and specifically the disposal of drill cuttings is the Dietzen U.S. Pat. No. 4,878,576 entitled "Method for Accumulating and Containing Borehole Solids and Recovering Drilling Fluids and Water on Drilling Rigs".

The Hansen U.S. Pat. No. 4,867,877 discloses a waste removal and/or separation system for removing liquid and solid wastes simultaneous from waste holding tanks or vessels.

A drill cuttings disposal method and system is disclosed in the Jackson U.S. Pat. No. 5,129,469. In the Jackson '469 patent, drill cuttings are disposed of by injecting into a subsurface formation by way of an annular space formed in a wellbore. The cuttings are removed from the drilling fluid, conveyed to a shearing and grinding system that converts the cuttings into a viscous slurry with the addition of water. The system comprises a receiving tank and a centrifugal pump for recirculating the mixture of cuttings and water (sea water) between the pump and the receiving tank. A discharge conduit is connected to the pump for moving the viscous slurry to an injection pump for high pressure injection into the formation. In the Prestridge et al. U.S. Pat. No. 5,303,786, drill cuttings a similar earth materials are reduced in particle size, slurried and disposed of from a system which includes a ball mill, a reduced particle receiving tank, a grinder pump and communication with the receiving tank and separator screens for receiving a slurry of particles which have been reduced in size through the ball mill and the grinder pump. The underflow of the separator is suitable for discharge for final disposal, oversized particles are returned to the ball mill and the underflow discharged from the separator is controlled to maintain a certain level in the primary receiving tank. A secondary tank may receive a portion of the underflow to be mixed with viscosifiers and dispersants to maintain a suitable slurry composition for discharge. The system may be mounted on a semi trailer and in weatherproof enclosures with the ball mill, receiving tanks and grinder pump on a first level and the separators on the second level. Receiving hoppers for wet drill cuttings as well as frozen or dried cuttings are provided and water or steam may be mixed with the cuttings and conveyed by a bucket elevator from a first level to a second level of the enclosures.

The Angelle U.S. Pat. Nos. 5,662,807 and 5,846,440 disclose an apparatus and method for handling waste. The apparatus includes a container having disposed thereon a rail member. The apparatus also contains a trolley mounted on the rail. The trolley has operatively associated therewith a handling system that has a wiper that extends into the container. The apparatus may also contain an auger, operatively mounted on the container, adapted for removing the waste from the container. A process for handling a discharged waste slurry is also disclosed. The Angelle patents discuss application to oil and gas well drilling and the fact that drilling fluid is an essential component of the drilling process and that the drilling fluid will contain solids which comprise rock and shale cuttings.

BRIEF SUMMARY OF THE INVENTION

The present invention provides a method for disposal of drill cuttings from an oil and gas well drilling platform. The method includes the steps of separating the drill cuttings from substantially all of the well drilling fluid in which the drill cuttings have been conveyed from an area being drilled.

The cuttings are then transferred to a materials collection area on a drilling platform or tower such as a materials collection trough. The drill cuttings are then transported to a holding tank using a vacuum and a first suction line.

A vacuum is generated within the holding tank using a blower so that drill cuttings are transported from the trough or collections area to the tank via a suction line.

Cuttings are then transferred from the holding tank to a work boat via a flow line. Further treatment such as recycling of drilling mud can be performed on the boat.

The drill cuttings are typically transported directly to a holding tank via a first suction line.

The vacuum is generated by a vacuum generating means or blower that is in fluid communication with the holding tank via a second suction line.

The work boat preferably provides its own holding tank of very large volume such as 100–1000 barrels. The holding tank on the work boat is likewise provided with a blower that pulls a vacuum on the tank to aid in transfer of cuttings from the holding tanks on the platform to the holding tank on the work boat.

In one embodiment, the boat is equipped with treatment units that process the cuttings. The cuttings can be slurried on one deck of the boat and then pumped for storage to another deck area on the boat. In yet another embodiment, the boat is equipped with treatment apparatus that separates and recycles drilling fluids such as more expensive synthetics. In a second embodiment, the work boat collects cuttings transferred to it from the drilling platform. The platform or tower has processing equipment that can slurrify or liquify cuttings to produce a desired particle size or viscosity.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
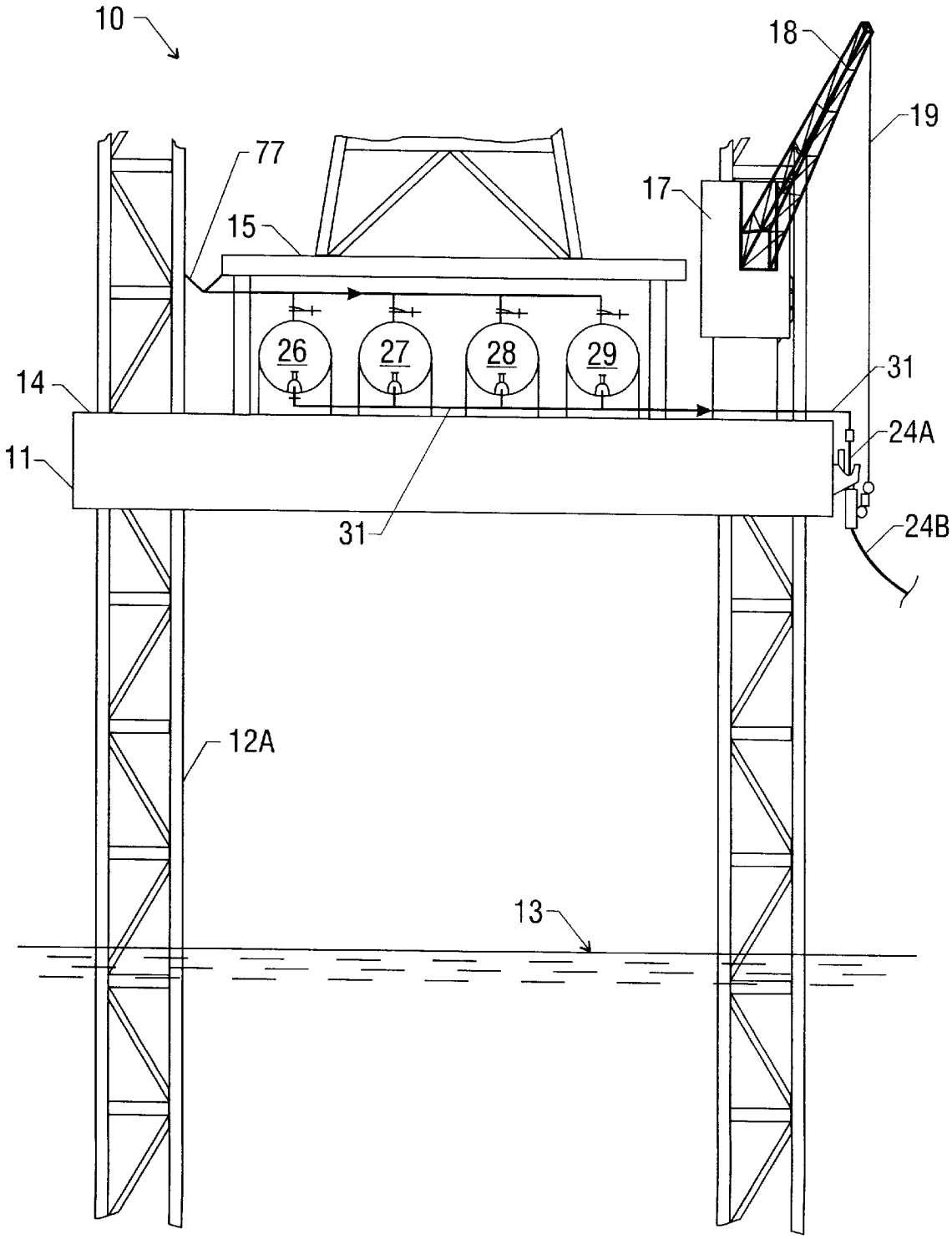
FIGS. 1–1A are elevational views of the preferred embodiment of the apparatus of the present invention.
Figure 1A:
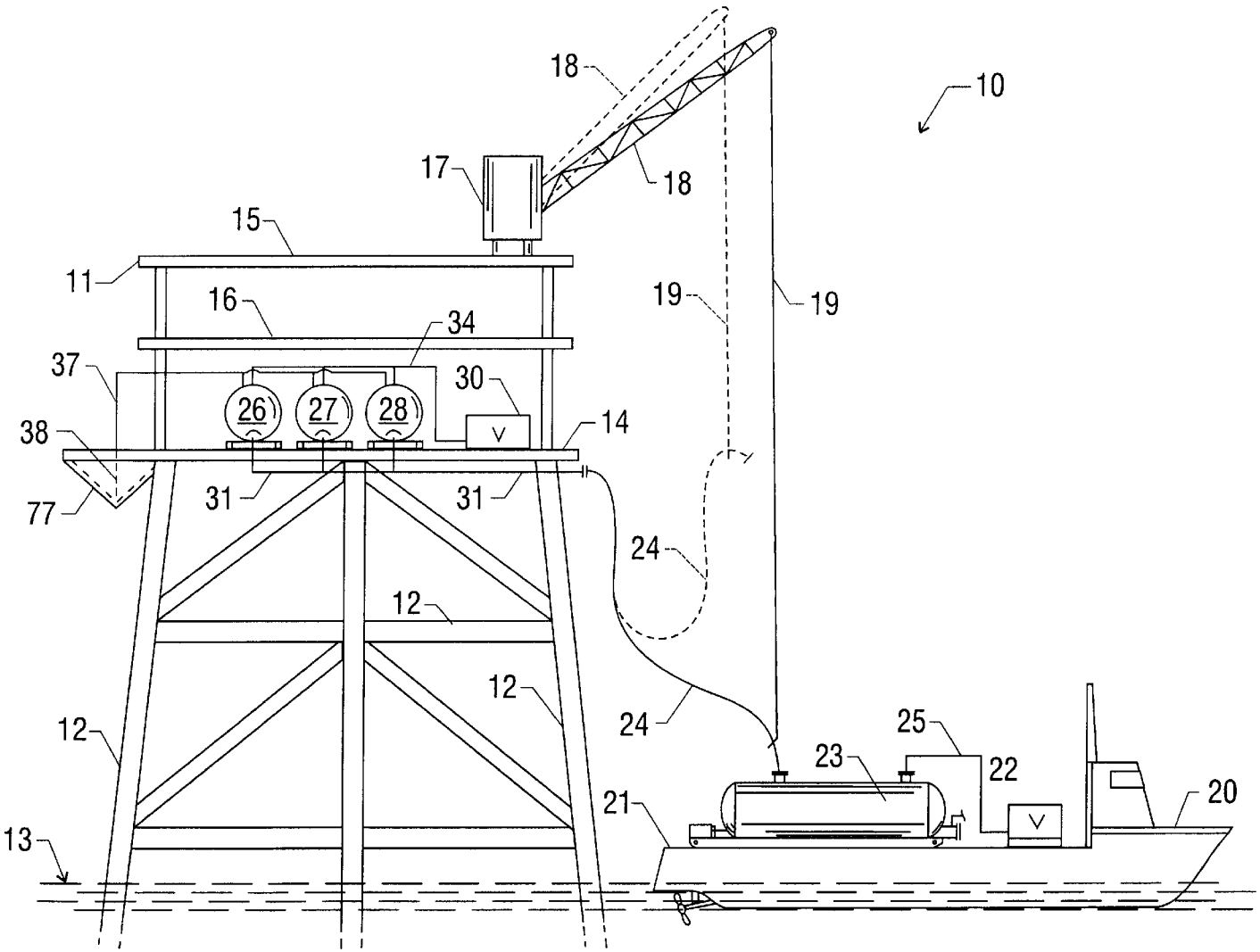
Figure 11:
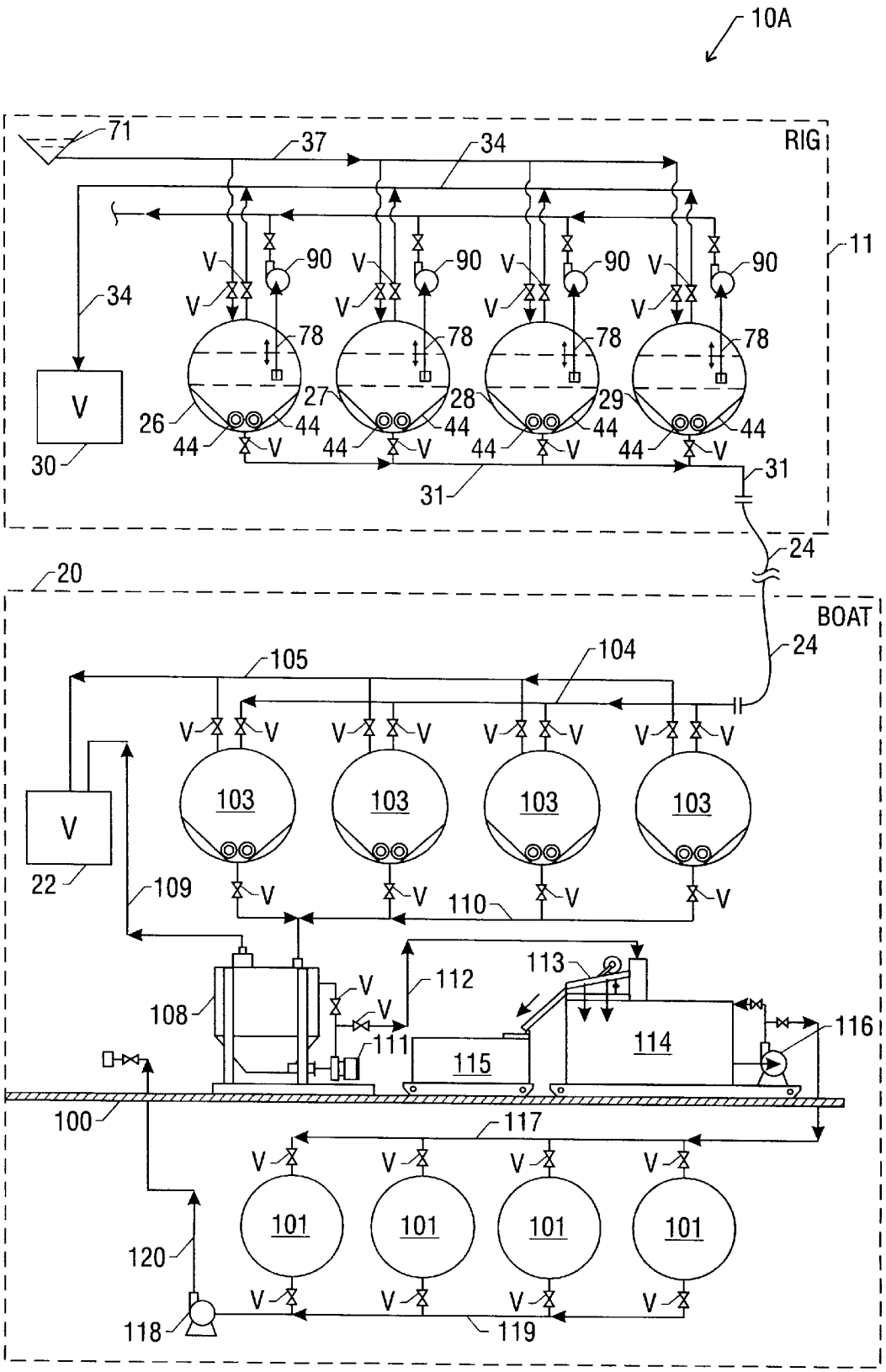
FIG. 11 is a schematic diagram showing the preferred embodiment of the apparatus of he present invention and utilizing the work boat of FIGS. 7 and 8.
Figure 12:
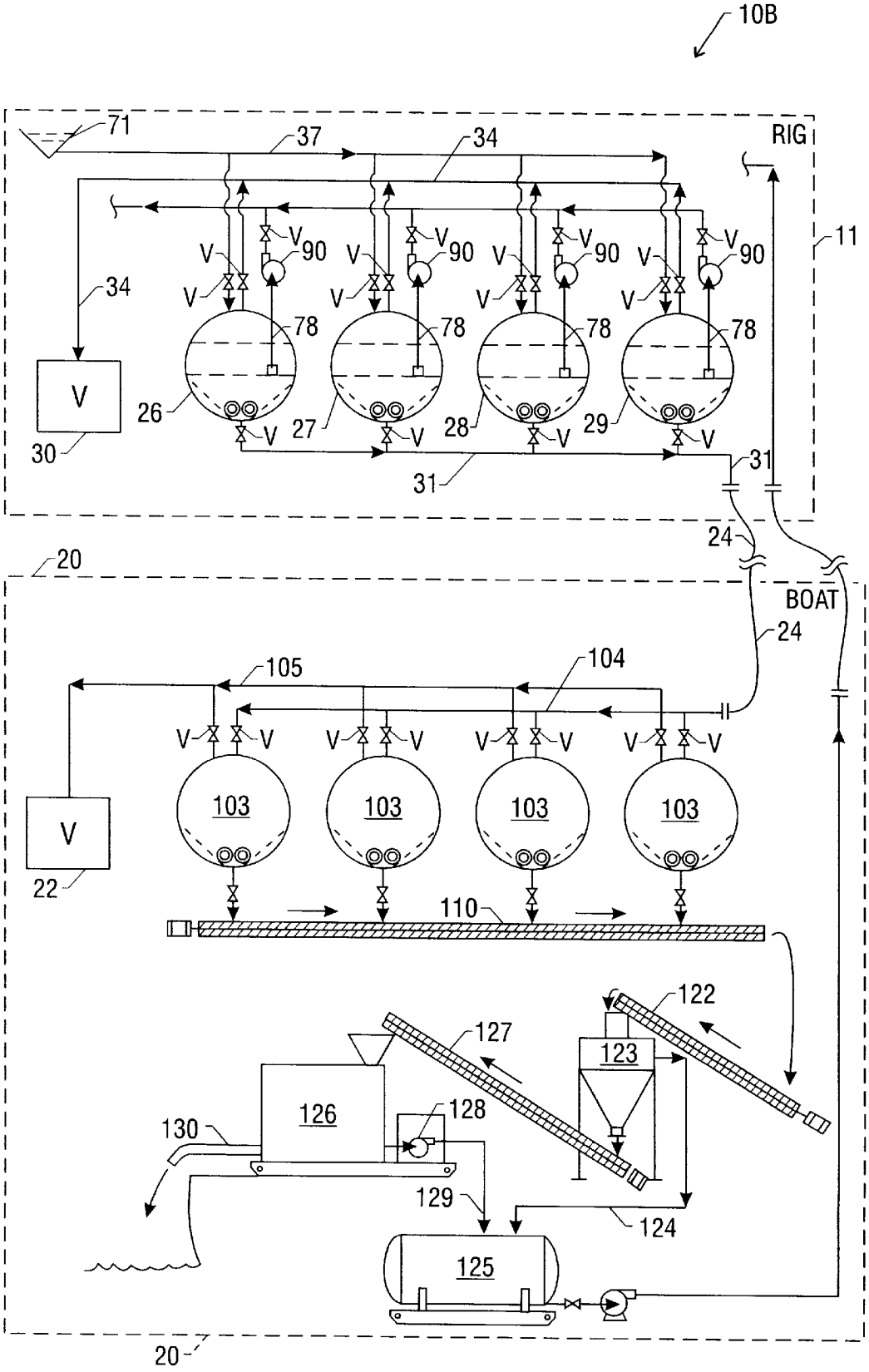
FIG. 12 is a schematic diagram of the preferred embodiment of the apparatus of the present invention and utilizing the work boat of FIGS. 9 and 10.

FIGS. 1–1A and 11–12 show generally the preferred embodiment of the apparatus of the present invention and the method of the present invention, designated generally by the numeral 10 in FIGS. 1, 1A and by the numerals 10A, 10B in FIGS. 11, 12 respectively. In FIG. 1, a jack-up rig type drilling vessel is shown for use with the method and apparatus of the present invention. In FIG. 1A, a fixed drilling platform is shown. Cuttings disposal apparatus 10 is shown in FIGS. 1–1A in an offshore marine environment that includes an offshore oil and gas well drilling platform 11. The platform 11 (FIG. 1A) can include a lower support structure or jacket 12 that extends to the ocean floor and a short distance above the water surface 13. The platform 11 can also be a jack-up rig (FIG. 1) or a semi-submersible. A superstructure is mounted upon the jacket 12 or upon jack-up rig legs 12A, the superstructure including a number of spaced apart decks including lower deck 14, upper deck 15 and in FIG. 1A an intermediate deck 16. Such a platform 11 typically includes a lifting device such as crane 17 having boom 18 and lifting line 19. In general, the concept of an offshore oil and gas well drilling platform is well known in the art.

In FIGS. 1A and 4–10, a work boat 20 is shown moored next to platform 11 for use in practicing the method of the present invention. Work boat 20 has deck 21 that supports vacuum unit 22, vacuum lines 25, and one or more storage tanks 23. In FIGS. 5–10, multiple tanks are provided, designated respectively by the numerals 23A–23E in FIGS. 5–6 and designated respectively of the numerals 101, 103 in FIGS. 7–10.

The drilling platform or drilling rig 11 supports one or more tanks for holding cuttings that have been removed from the well bore during drilling, such as the plurality of rig tanks 26, 27, 28 in FIG. 1A and tanks 26, 27, 28, 29 in FIG. 1.

Figure 15:
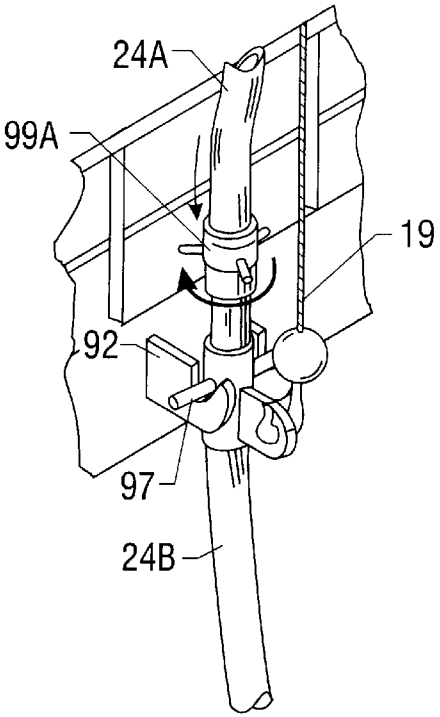
FIGS. 14 and 15 are fragmentary perspective views of the preferred embodiment of the apparatus of the present invention showing the hose used to off load cuttings from rig to boat.
Figure 14:
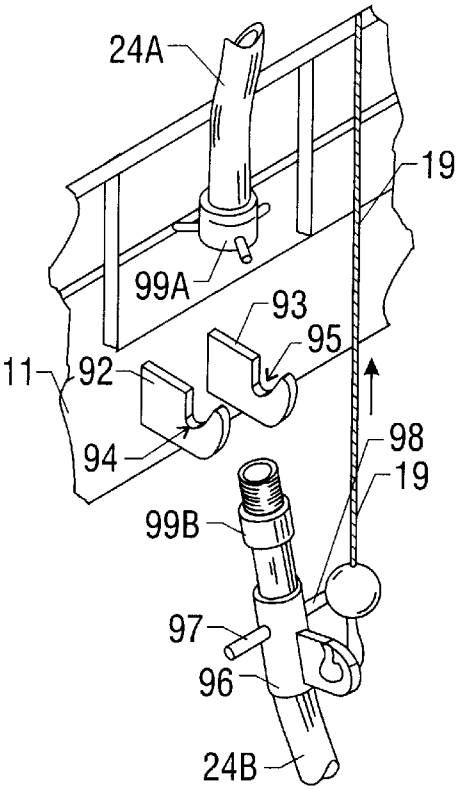
Figure 13:
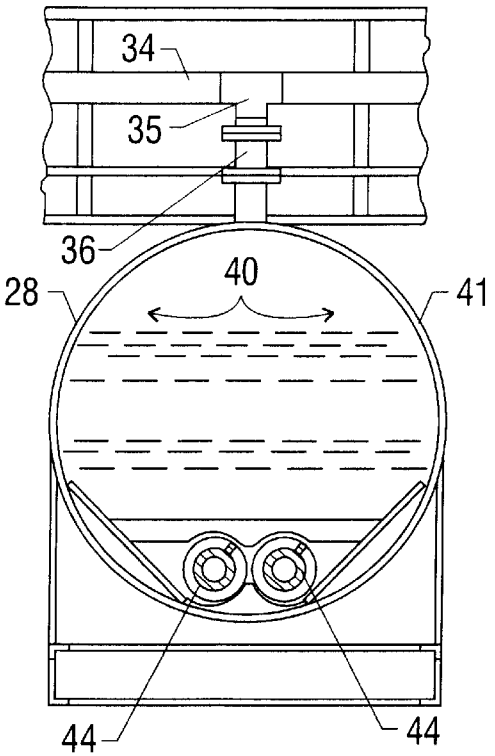
FIG. 13 is a sectional view taken along lines 13—13 of FIG. 5.

The tanks 23 and 23A–23E on boat 20 are preferably very large tanks, each having a volume of between for example between 100 and 1000 barrels. The tanks 26–29 on platform 11 can be, for example, between about 50 and 1000 barrels in volume each. A suction line 24, 24A, 24B can be used to form a removable connection between the plurality of rig vacuum tanks 26, 27, 28, 29 and the boat storage tanks 23 or 23A–23E. The suction line 24 can be attached for example to a discharge manifold 31 (see FIGS. 1, 1A and 2). In another embodiment, (see FIGS. 7–10), the suction line 24 can be used to transmit cuttings from tanks 26, 27, 28, 29 to an underwater storage tank, as will be described more fully hereinafter. In FIGS. 14, 15, a connection arrangement is shown for joining line 24 between platform 11 and boat 20.

During oil and gas well drilling operations, a receptacle on rig 11 such as trough 77 receives drill cuttings that are removed from the well bore and preferably after those drill cuttings have been subjected to solids control, such as the removal of drilling fluids (e.g. drilling mud) therefrom.

Figure 2:
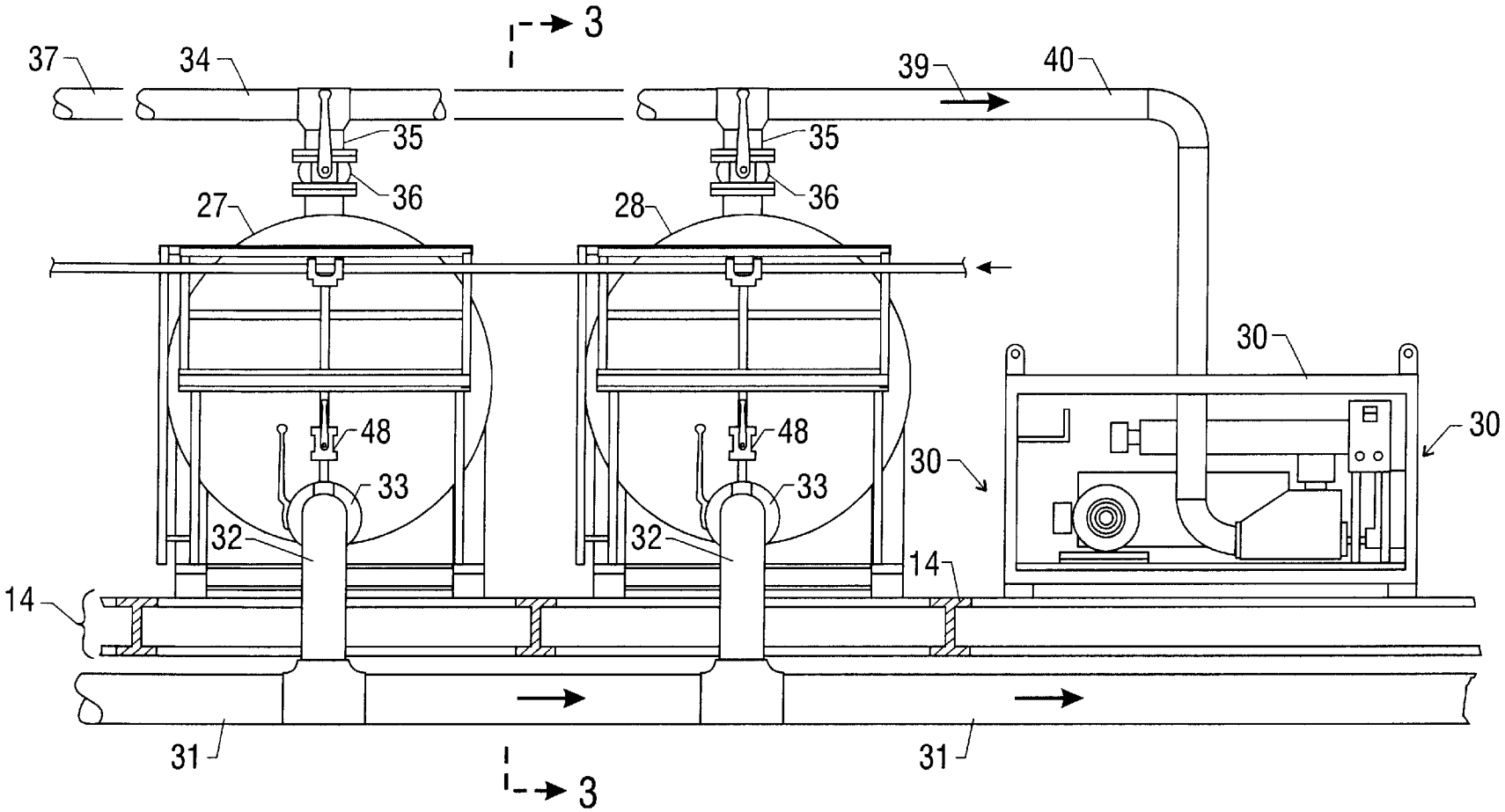
FIG. 2 is a partial elevational view of the preferred embodiment of the apparatus of the present invention.

Cuttings in trough 77 are moved from the trough 77 to one or more of the storage tanks 26, 27, 28, 29 using a vacuum unit 30. Vacuum unit 30 is connected to suction manifold 34 as shown in FIGS. 1A and 2. Arrow 39 in FIG. 2 shows the direction of air flow in header 34. The suction manifold 34 communicates between vacuum unit 30 and each of the rig vacuum tanks 26, 27, 28, 29 via a spool piece or suction line 35. The suction line 35 includes valve 36 for valving the flow of air from each tank 26, 27, 28, 29 to vacuum unit 30 via suction manifold 34. An additional suction manifold 37 communicates with each of the tanks 26, 27, 28, 29 and with trough 77 via suction intake 38. In this fashion, valving enables cuttings to be transmitted to any selected tank 26, 27, 28, 29.

Valves 36 control flow of cuttings between each tank 26, 27, 28, 29 and manifold 37. Pressurized air from supply header 45 can be injected into discharge line 32 downstream of valve 33 to assist the flow of cuttings. Valves 48 can be used to valve such air flow. Once vacuum unit 30 is activated, drill cuttings in trough 77 are suctioned from trough 29 using the intake 38 end of header 37. The intake end 28 of suction header 37 can be in the form of a 3"–8" flexible hose, for example. Cuttings can then be transmitted via header 37 to the desired tank 26, 27, 28 or 29.

Figure 3:
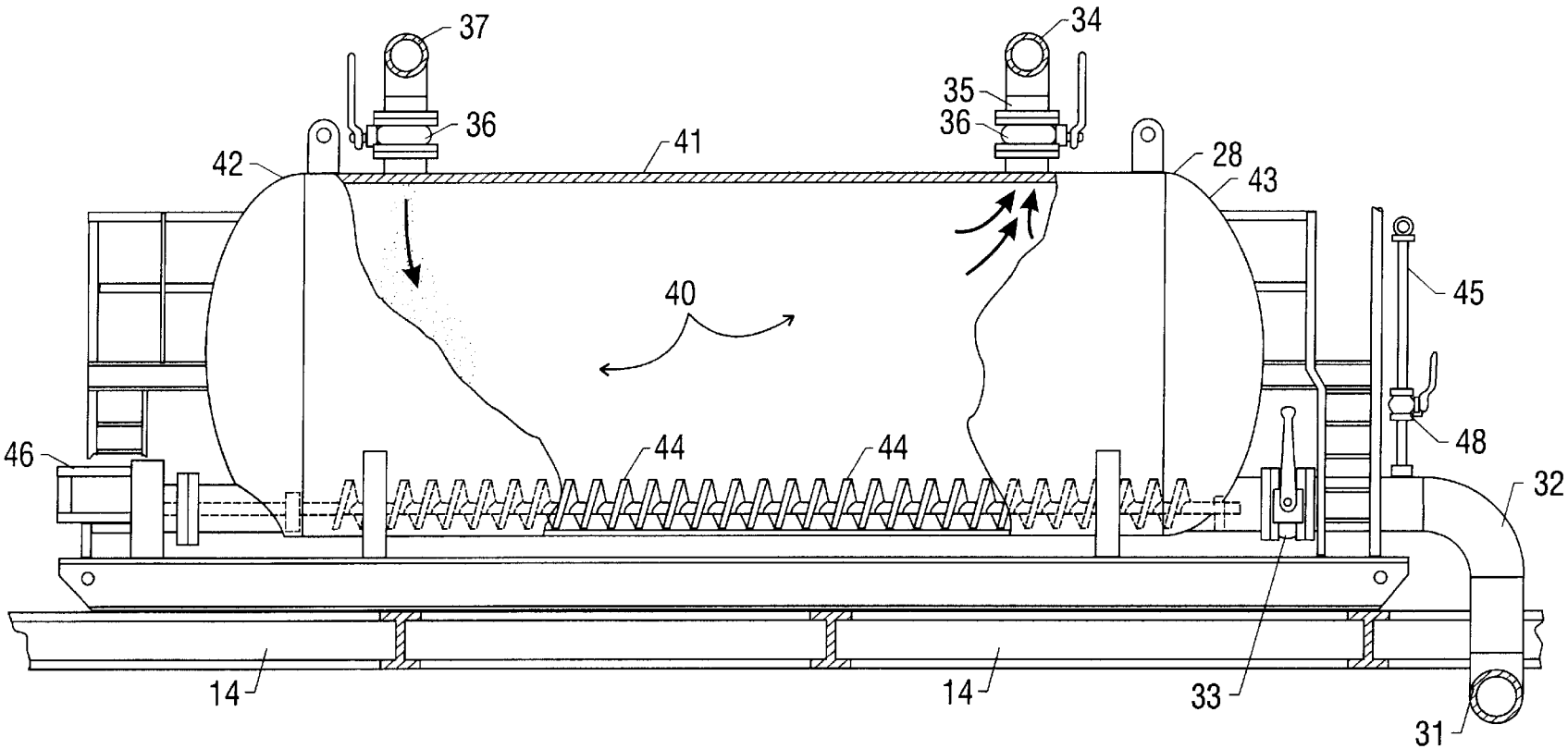
FIG. 3 is a sectional view taken along lines 3—3 of FIG. 2.

FIGS. 2, 3, 3A and 13 show the construction of one of the rig vacuum tanks 26, 27, 28, 29 more particularly. In FIG. 3, 3A, the tank 28 is shown as a pressure vessel capable of holding a desired vacuum or pressure valve and having an interior 40 surrounded by cylindrically shaped side wall 41 and two dished end portions 42, 43. At the lower end of tank 28 interior 40, an auger or augers 44 can be used to transfer cuttings that settle in tank 28 to discharge line 32. The well drill cuttings can then enter manifold 31. A valve 33 can be positioned in between each tank 26, 27, 28 and discharge line 32 for valving the flow of cuttings from the tank interior 40 to discharge manifold 31. Auger 44 can be operated by motor drive 46, having a geared transmission as an interface between motor drive 46 and auger 44.

Figure 3A:
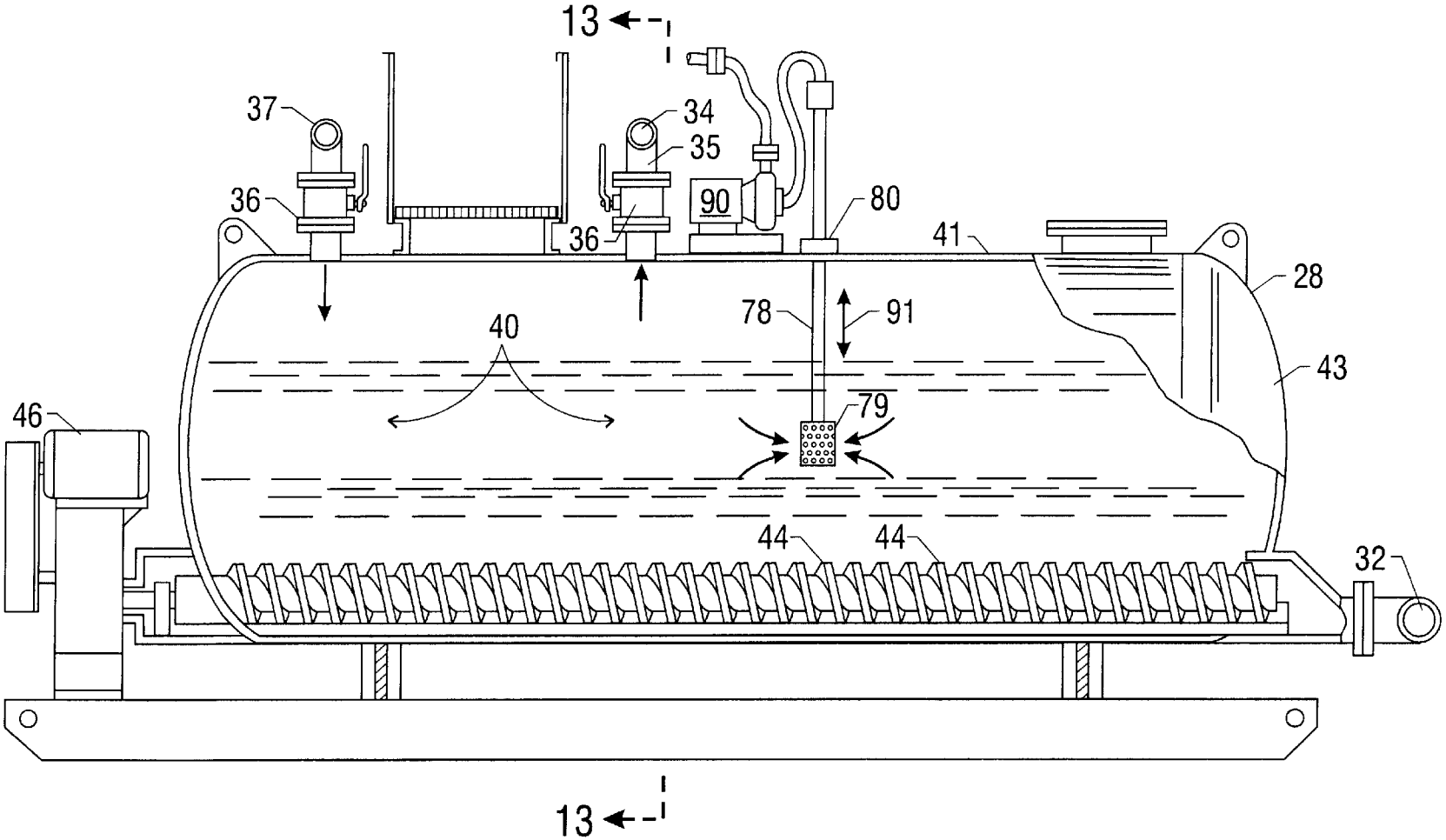
FIG. 3A is a sectional view illustrating an alternate construction for the tank shown in FIGS. 2 and 3.
Figure 4:
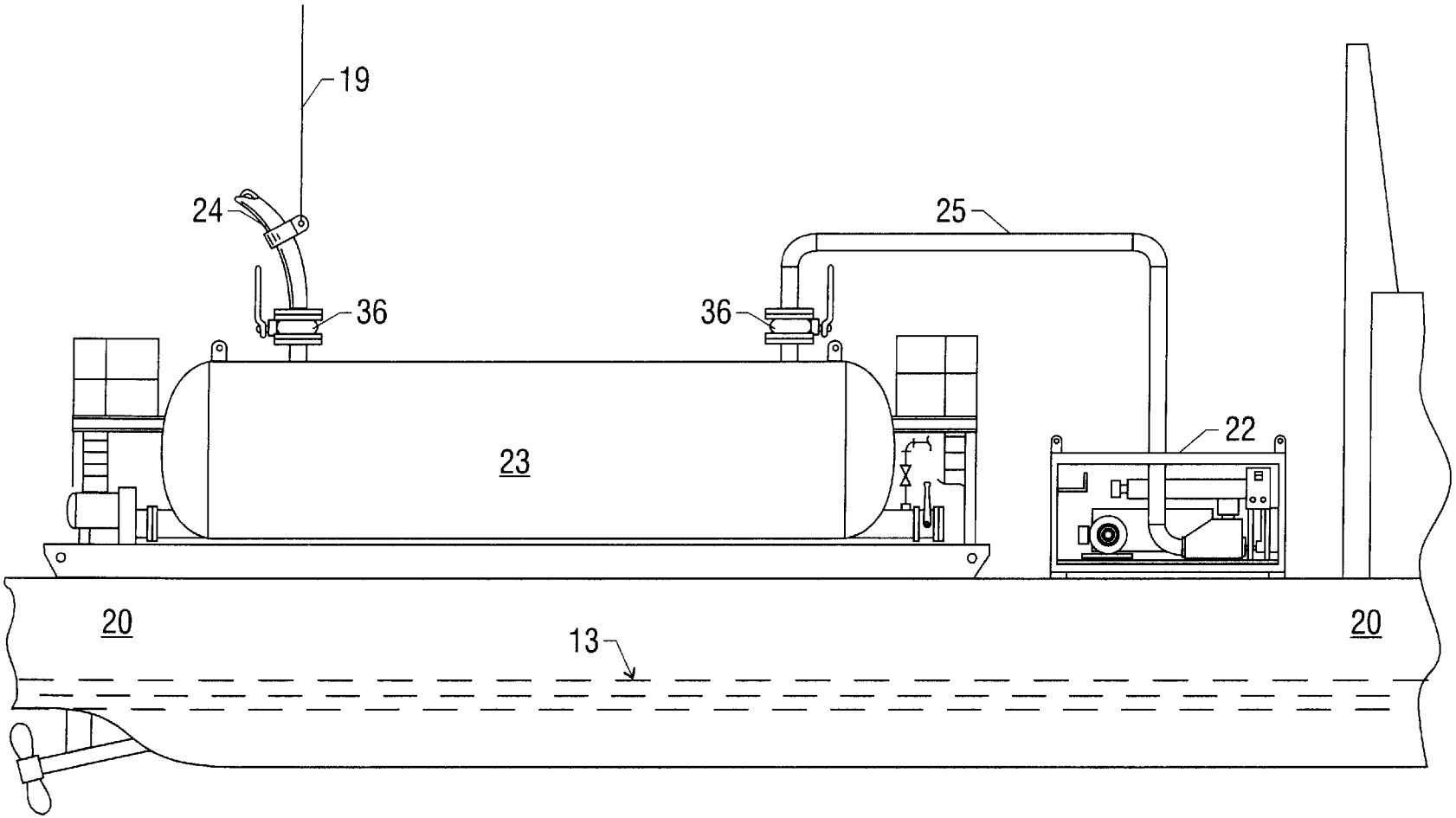
FIG. 4 is a fragmentary elevational view of the preferred embodiment of the apparatus of the present invention illustrating the boat, vacuum unit and tank situated on the deck of the boat.

The tank 28 in FIG. 3A has some features that are optional and additional to the tank 28 of FIG. 3. Tank 28 in FIG. 3A has a cylindrically shaped side wall 41 and dished end portions 42, 43. Augers 44 can be used to transfer cuttings that settle in tank 28 to discharge 32. Drilling fluid to be recycled can be suctioned from interior 40 of tank 28 using suction line 78 that is adjustable up and down as shown by arrow 91 in FIG. 3A. The suction line 78 can be used to recycle drilling fluid after solids within the interior 40 of tank 28 have settled, leaving the drilling fluid as the upper portion of the material contained within interior 40 of tank 28. Suction line 79 fits through sleeve 80 that can be fitted with a set screw, pin, taper lock fitting or similar fitting to grasp suction line 78 at the desired elevational position.

In FIGS. 14 and 15, a connection is shown that can be used to join the hose 24 that transmits cuttings from the rig 11 to the boat 20. In FIGS. 14 and 15, the hose 24 can be in two sections, 24A, 24B that are joined together using fittings 99A–99B. Crane lift line 19 attaches with its lower end portion to fitting 96 using a hook, for example, and an eyelet on the fitting 96 as shown in FIG. 14. The fitting 96 can include a pair of spaced apart transversely extending pins 97, 98 that fit recesses 94, 95 respectively on respective saddle plates 92, 93 that are welded to the rig 11 as shown in FIG. 14. In this fashion, the rig operator can raise the lower portion 24B of hose 24 upwardly until the pins 97, 98 engage the recesses 94, 95 as shown in FIG. 15. With the hose lower end portion 94B so supported by the saddle plates 92, 93, the pins 97, 98 rest in the recesses 94, 95. A rig operator then connects the coupling member 99A to the coupling member 99B as shown in FIGS. 14 and 15. The upper end portion 24A of hose 24 can be connected to header 31 as shown in FIG. 1.

Figure 7:
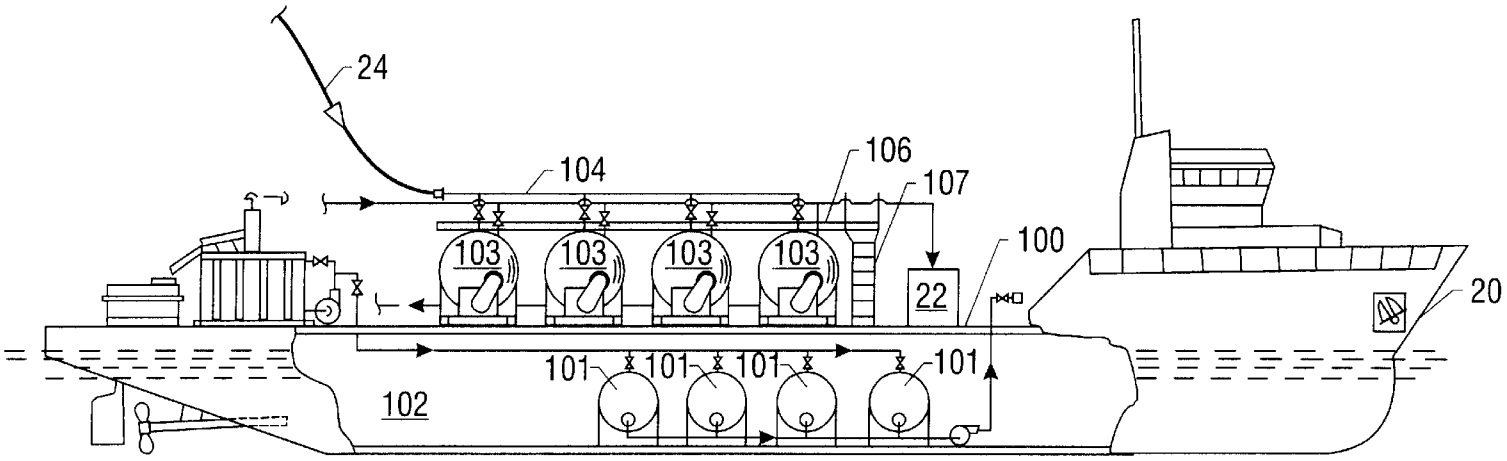
FIG. 7 is an elevational view of the preferred embodiment of the apparatus of the present invention showing an alternate arrangement of storage tanks on the work boat portion thereof.
Figure 8:
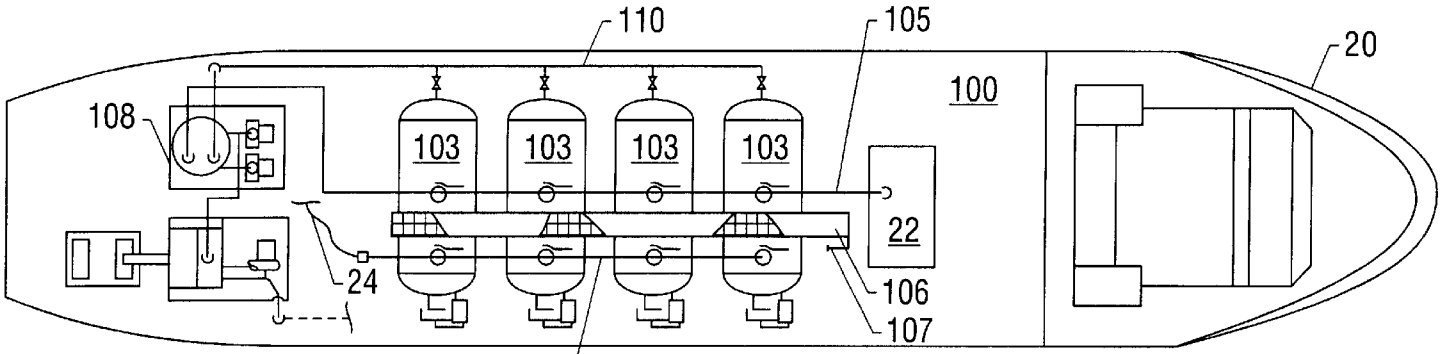
FIG. 8 is a top, plan view of the work boat of FIG. 7.

FIGS. 7–8 and 11 shown an alternate arrangement of the apparatus of the present invention that incorporates optional treatment features on the boat 20. In of FIGS. 7, 8 and 11, the boat 20 is shown outfitted with storage tanks 103 in addition to optional processing equipment that further processes the mixture of cuttings and drilling fluids that are transmitted to the boat 20 via flow line 24.

In FIGS. 7 and 8, the vessel 20 has an upper deck 100 with a plurality of tanks 101 stored under the deck 100 in hold 102, and a second plurality of tanks 103 above deck 100 as shown in FIGS. 7 and 8. Vacuum system 22 on the boat 20 can pull a vacuum on any selected one of the tanks 26–29. Each rig tank 26–29 in FIG. 11 provides a discharge that communicates with discharge header 31. The tanks 26–29 are constructed in accordance with the tank 28 of FIG. 3 or 3A.

In FIGS. 7–8 and 11, the boat 20 is provided with optional equipment to further treat the cuttings that are collected in the plurality of tanks 103 after the cuttings or a mixture of cuttings and drilling fluid has been transferred via flow line 24 to the boat 20.

The cuttings received in the plurality of tanks 103 on the upper deck 100 of vessel 20 are further treated to slurrify the combination of cuttings and drilling fluid in order to obtain a desired particle size and a desired viscosity. This enables this further treated mixture of cuttings and fluid to be pumped into tanks 101 that are under deck 100. In this fashion, storage can be maximized by slurrifying, and storing the cuttings/drilling fluid mixture in the tanks 101 that are under deck 100 in hold 102.

In FIGS. 7, 8 and 11, the flow line 24 transmits cuttings to header 104 that is valved with valves V so that incoming cuttings can be routed to any particular of the tanks 103 as desired. Vacuum unit 22 on boat 20 can pull a vacuum through header 105 on any selected tank 103. This is because each of the tanks 103 is valved with valves V between the tank 103 and header 105. A walkway 106 accessible by ladder 107 enables an operator to move between the various valves V and headers 104, 105 when it is desired to open a valve V or close a valve V that communicates fluid between a header 104 or 105 and a tank 103.

By closing all of the valves V that are positioned in between a tank 103 and the vacuum header 105, the vacuum can be used to pull a vacuum on cuttings grinder unit 108 via flow line 109 (see FIG. 11). A discharge header 110 is used to communicate discharged fluid that leaves a tank 103 to cuttings grinder unit 108. Valves V are used to control the flow of fluid between each tank 103 and header 110 as shown in FIG. 11. Pump 111 enables material to be transferred from cuttings grinder unit 108 via flow line 112 to shaker 113 and holding tank 114. Material that is too large to be properly slurried is removed by shaker 113 and deposited in cuttings collection box 115 for later disposal. Material that passes through shaker 113 into holding tank 114 is slurried by recirculation from tank 114 to pump 116 and back to tank 114. When a desired particle size and viscosity are obtained, the slurry is pumped with pump 116 to one of the tanks 101. Each of the tanks 101 is valved between discharge header 119 and tanks 101 as shown in FIG. 11.

When the boat 20 reaches a desired disposal facility, pump 118 receives fluid from discharge header 119 for transmission via line 120 to a desired disposal site such as a barge, on land disposal facility or the like.

Figure 9:
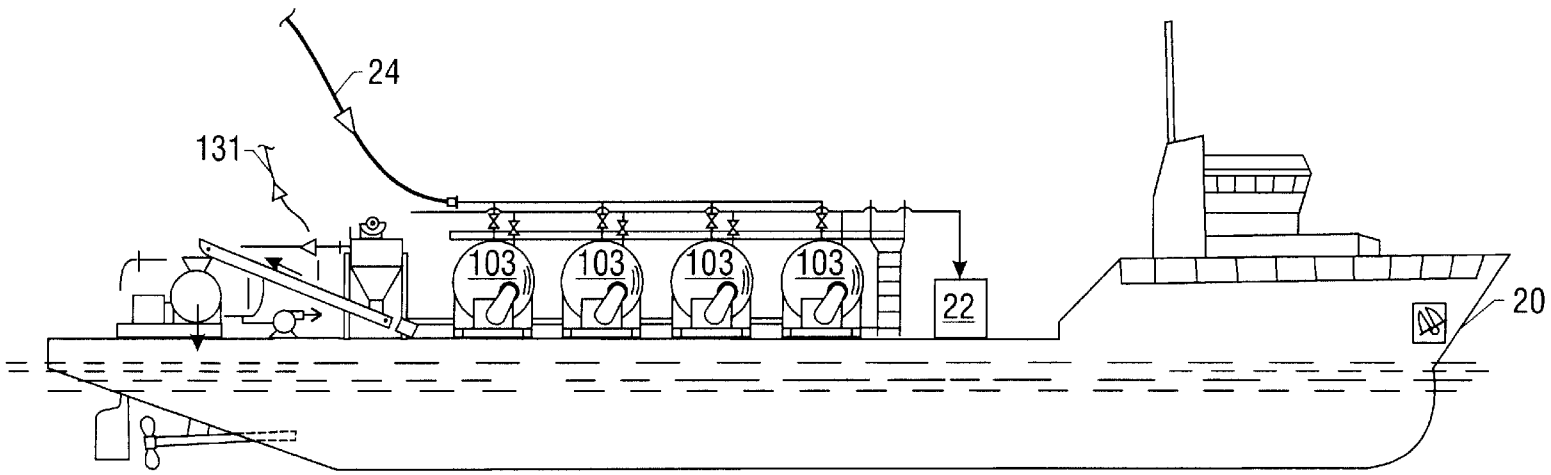
FIG. 9 is an elevational view of the preferred embodiment of the apparatus of the present invention showing another alternate arrangement of storage tanks on the work boat portion thereof.
Figure 10:
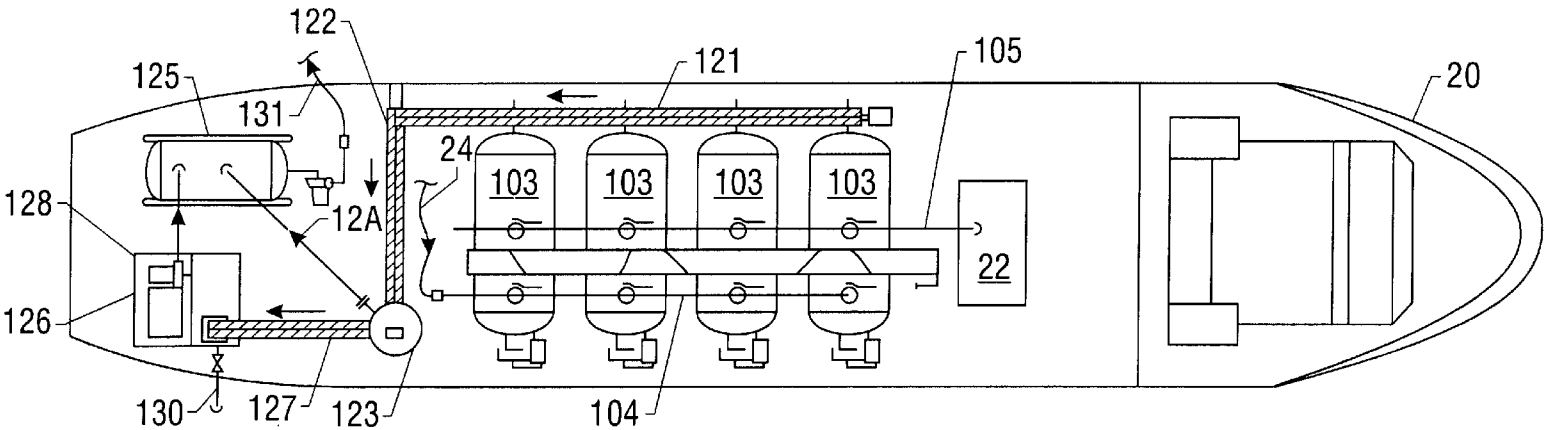
FIG. 10 is a top, plan view of the work boat of FIG. 9.

In FIGS. 9–10 and 12, the apparatus of the present invention is shown fitted with optional treatment features, designated generally by the numeral 10B in FIG. 12. In the embodiment of FIGS. 9, 10 and 12, processing is used to remove desirable drilling fluid from cuttings that are transferred to boat 20 via line 24. In FIGS. 9, 10 and 12, the rig 11 has a plurality of tanks 26–29, and inlet header 37, a vacuum system 30, a vacuum header 34, and pumps 90 to remove desirable drilling fluid at the rig or platform 11 for recycling. However, in FIGS. 9–10 and 12, recycling of drilling fluid also occurs on boat 20. Thus, the equipment located on rig 11 is the same in the embodiment of FIGS. 11 and 12. The equipment on boat 20 differs in the embodiment of FIGS. 9–10 and 12. The boat 20 in FIGS. 9–10 and 12 includes a plurality of tanks 103 that discharge cuttings to a first conveyor such as auger 121. Auger 121 directs cuttings that are discharged by tanks 103 to a conveyor such as screw conveyor 122. Screw conveyor 122 deposits cuttings in separator 123. In separator 123, some drilling fluids are removed and transmitted via flow line 124 to recycled liquid holding tank 125. The separator 123 is preferably a hopper with a vibrating centrifuge, spinning basket driven by a motor. Such separators 123 are commercially available.

After drilling fluid has been separated at separator 123, dry cuttings are transmitted to cuttings dryer unit 126 using screw conveyor 127. The cuttings dryer unit 126 further dries the cuttings so that they can be transferred to a vessel, barge, etc. or dumped overboard via discharge pipe 130. Any fluid that is removed from the cuttings at cuttings dryer unit 126 can be recycled through pump 128 and flow line 129 to liquid holding tank 125 and then to the platform 11 via flow line 131.

Figure 5:
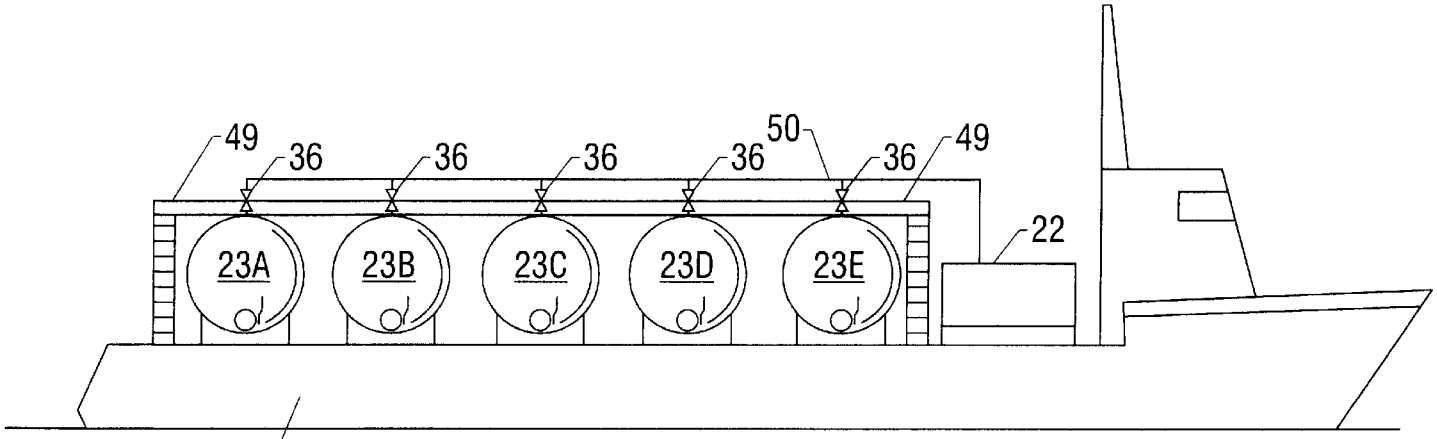
FIG. 5 is an elevational view of the preferred embodiment of the apparatus of the present invention showing an alternate arrangement of storage tanks on the work boat portion thereof.
Figure 6:
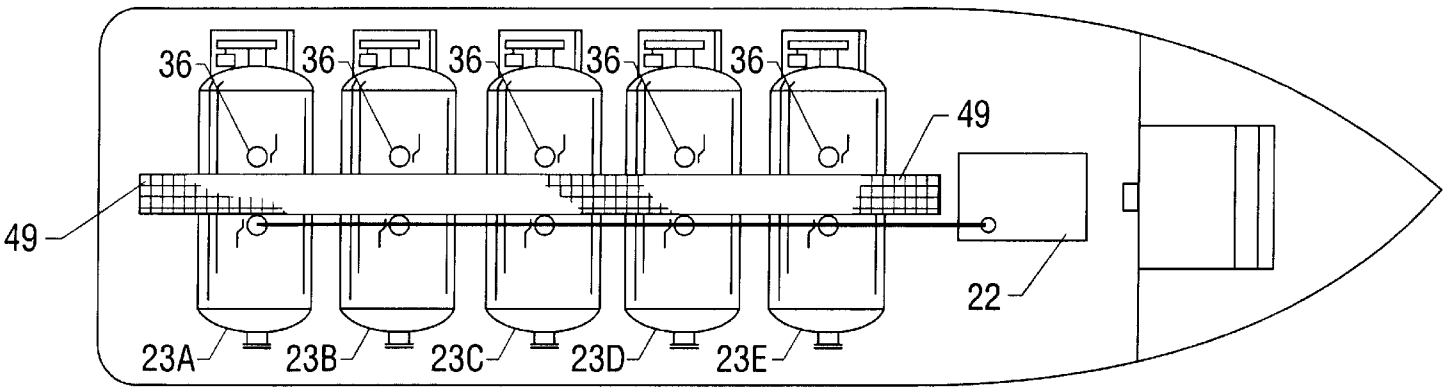
FIG. 6 is a plan view of the preferred embodiment of the apparatus of the present invention showing the work boat configuration of FIG. 5.

FIGS. 16–19 show an underwater tank assembly 51 that can be used to replace or supplement the tank 23 of FIG. 1 or the plurality of tanks 23A–23E in FIGS. 5 and 6. In FIGS. 16–19, underwater tank assembly 51 can be stored on the sea bed 74 so that it does not occupy rig space or space on the deck 21 of vessel 20. Rather, the underwater tank assembly 51 can receive cuttings that are discharged from tanks 26, 27, 28 on rig 11 by discharging the cuttings from the selected tank 26, 27, 28 via header 31 and into cuttings flow line 60. The cuttings flow line 60 can be attached to header 31 in a similar fashion to the attachment of flow line 24 shown in FIG. 1.

The flowline 21 transmits cuttings from header 31 to tank 23 on boat 20 or to a plurality of tanks 23A–23E on boat 20.

The cuttings flow line 60 would be of sufficient length to extend from the discharge flowline 31 to the sea bed 74 and specifically to inlet fitting 59 on main tank 52 of underwater tank assembly 51, as shown in FIG. 7. In this fashion, cuttings can be discharged from the rig 11 tanks 26, 27, 28 to underwater tank assembly 51 in the direction of arrow 61. As with the embodiment of FIGS. 1–6, a vacuum unit such as vacuum unit 22 on vessel 20 or a vacuum unit such as vacuum unit 30 on rig 11 can be used to pull a vacuum on main tank 52.

Figure 16:
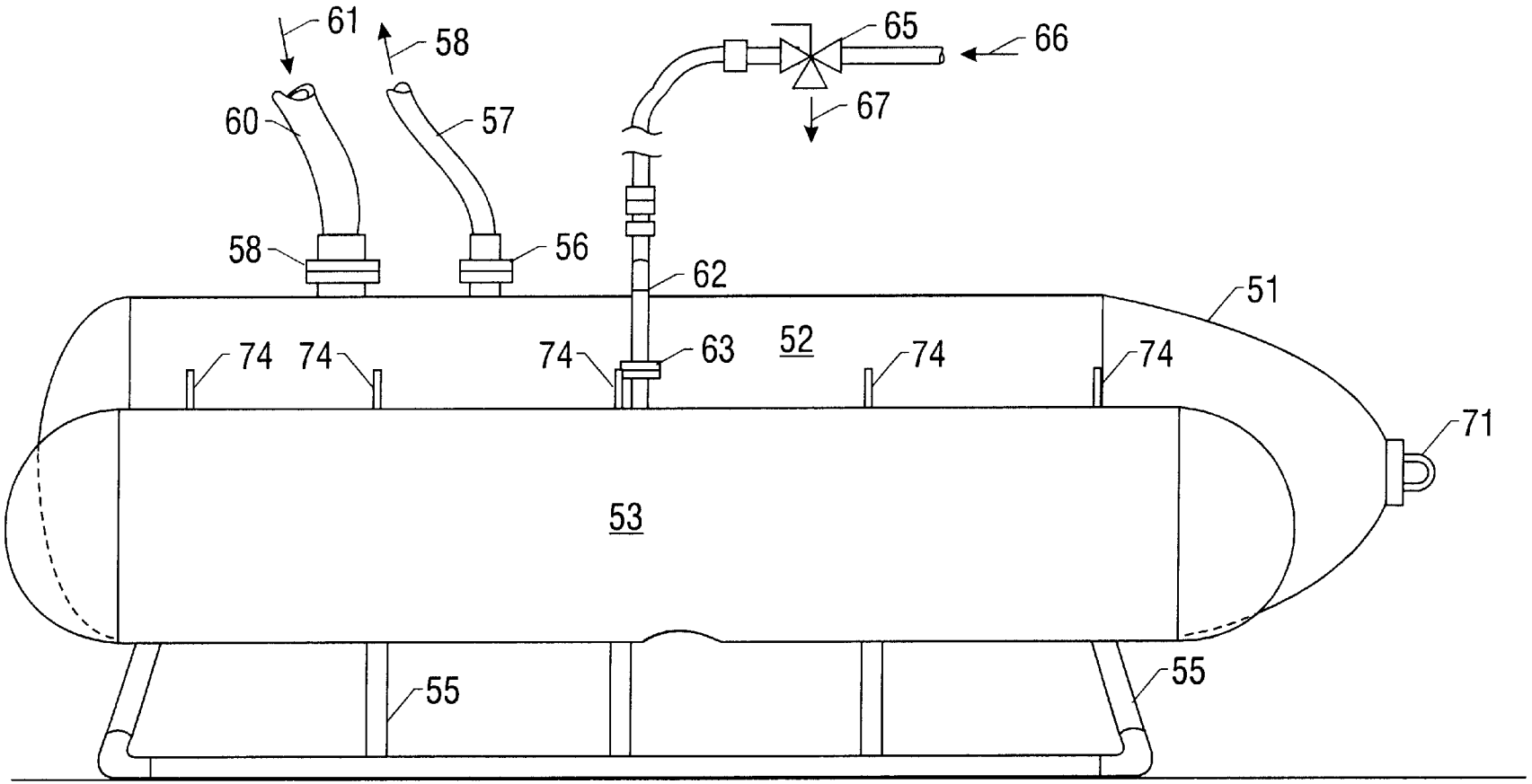
FIG. 16 is an elevational view of an underwater storage tank for use with the method of the present invention and showing an alternate apparatus of the present invention.
Figure 17:
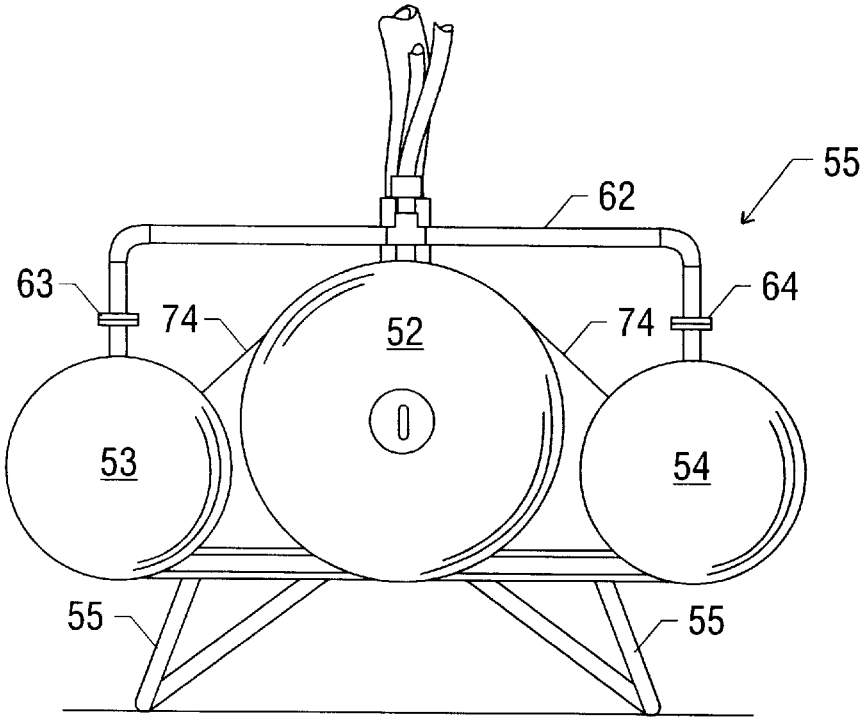
FIG. 17 is an end view of the underwater storage tank of FIG. 7.
Figure 18:
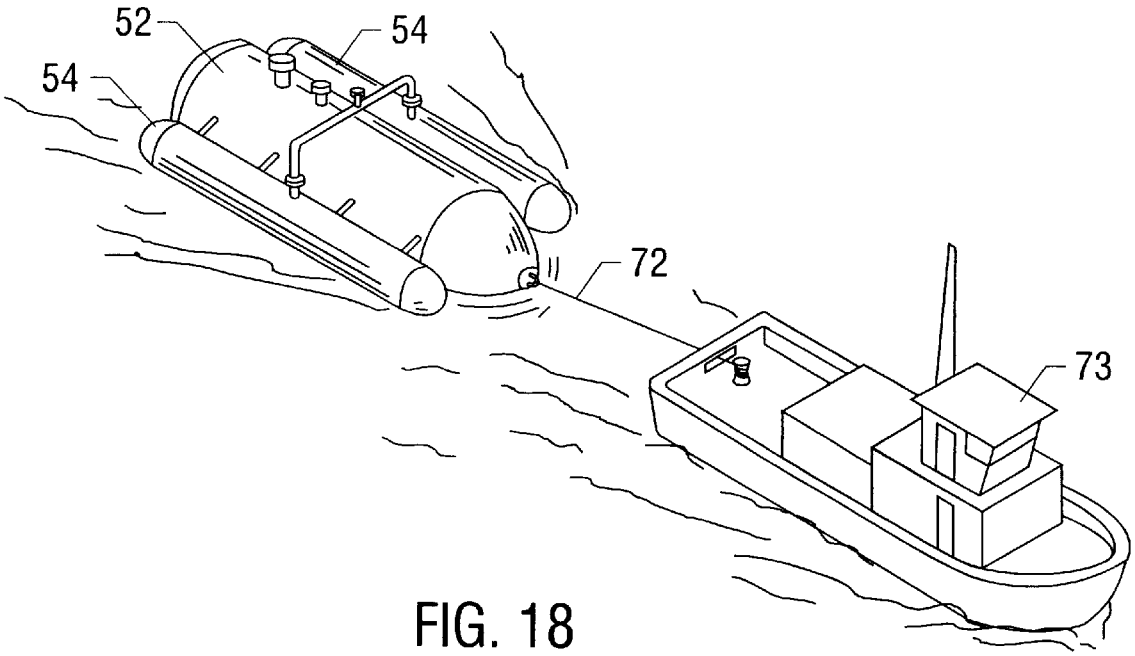
FIG. 18 is a perspective view of the storage tank of FIGS. 7 and 8 while in tow.

In FIG. 16, main tank 52 provides a vacuum fitting 56 to which vacuum line 57 is attached. A vacuum unit 22 or 30 can pull a vacuum on tank 52 with air flowing in the direction of arrow 58. This flow enhances the flow of cuttings from the tanks 26, 27, 28 on rig 11 into main tank 52 in the direction arrow 61.

The main tank 51 has ballasting in the form of a plurality of ballast tanks 53, 54. The combination of tanks 52, 53, 54 are connected by a welded construction for example using a plurality of connecting plates 74.

Ballast piping 62 communicates with fittings 63, 64 that are positioned respectively on the ballast tanks 53, 54 as shown on FIG. 8. Control valve 65 can be used to transmit pressurized air in the direction of arrow 66 into the ballast tanks 53, 54 such as when the underwater tank assembly 51 is to be raised to the surface, as shown in FIG. 10, the upward movement indicated by arrows 75.

Figure 19:
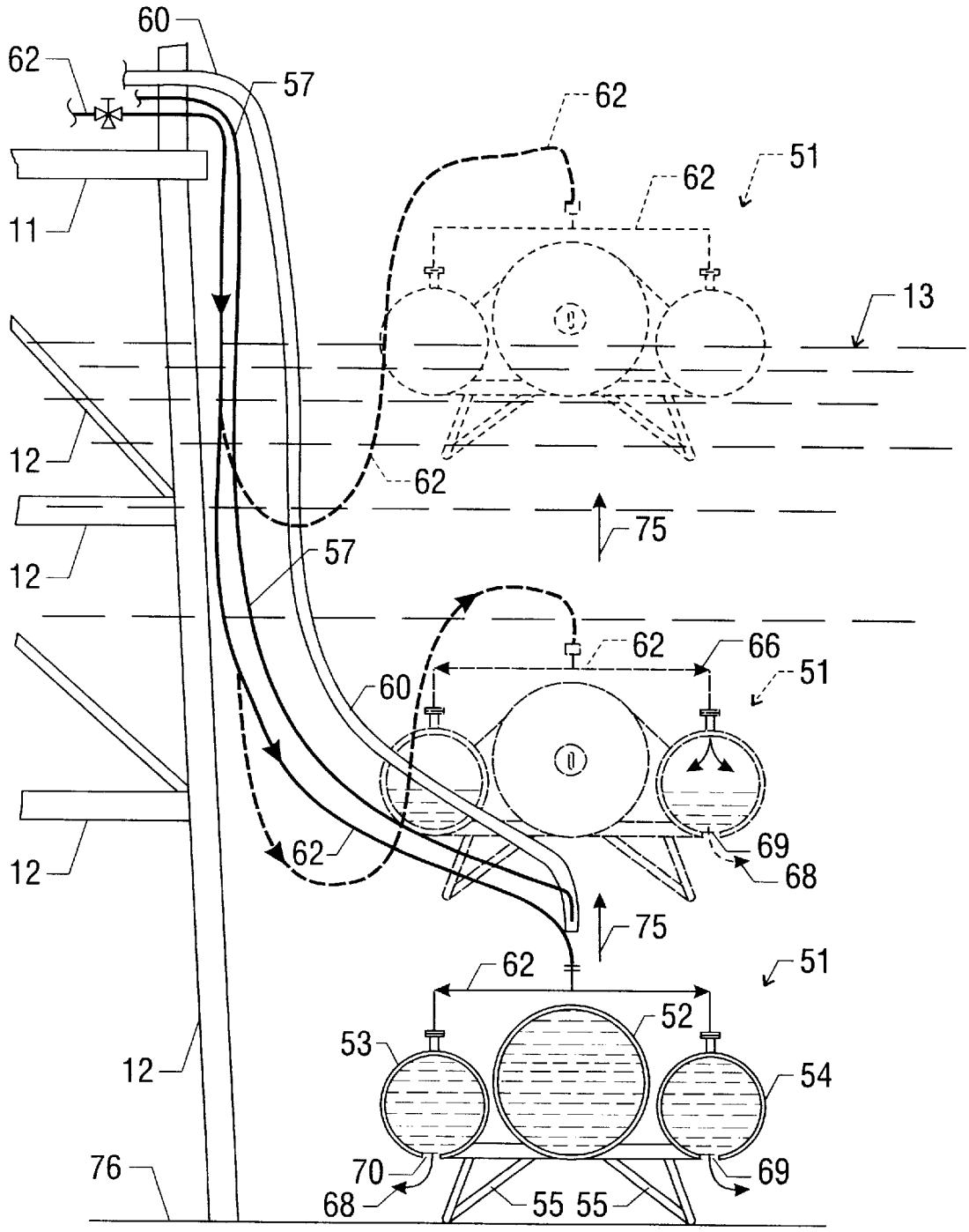
FIG. 19 is a schematic view of the alternate embodiment of the apparatus of the present invention and showing the alternate method of the present invention using an underwater storage tank.
Figure 20:
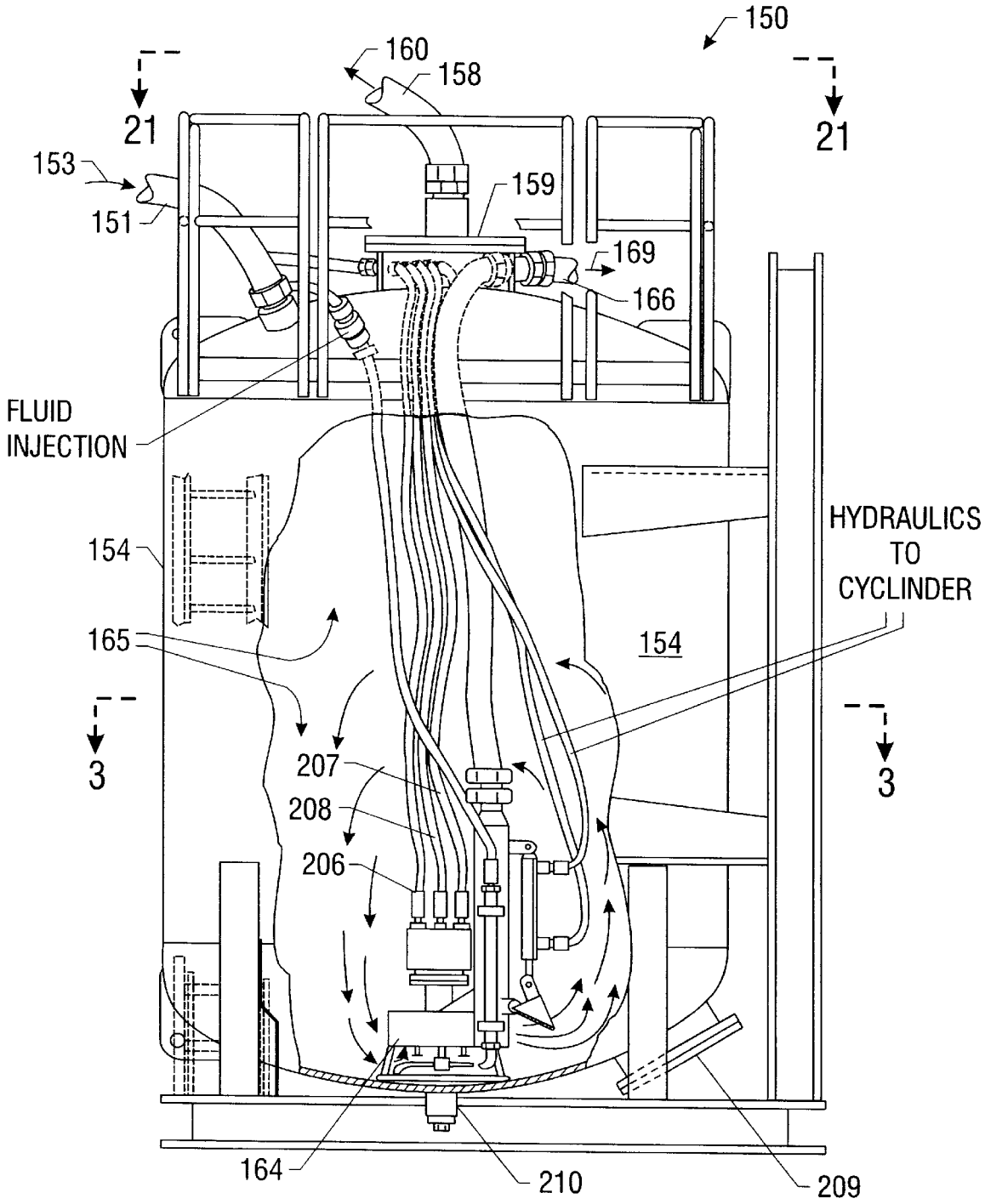
FIG. 20 is a fragmentary perspective view of a second embodiment of the apparatus of the present invention.
Figure 21:
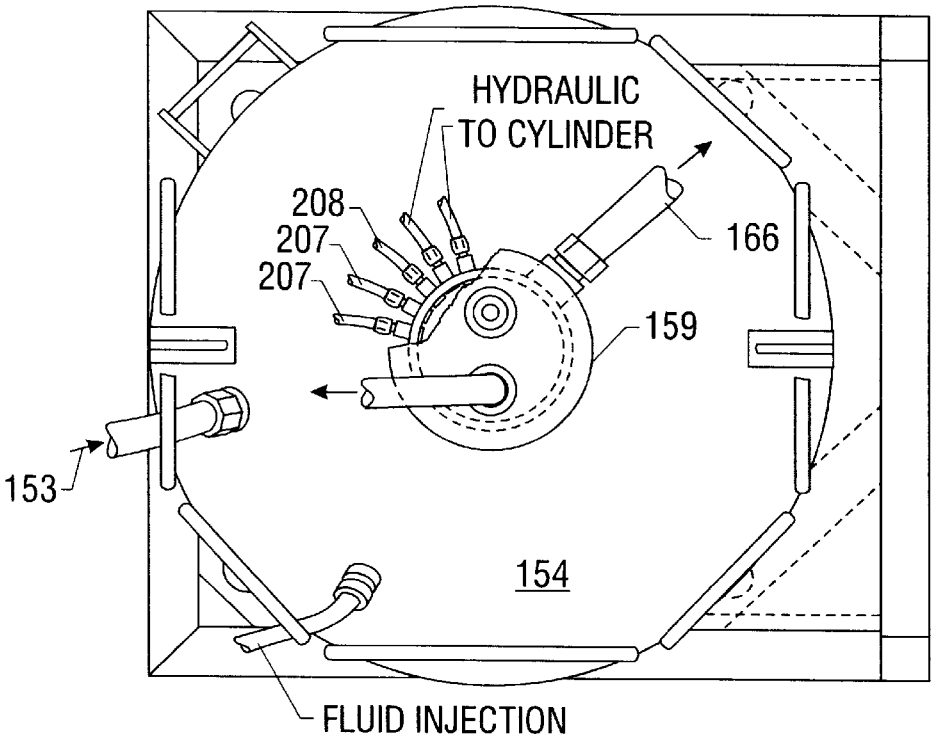
FIG. 21 is a sectional view taken along lines 21—21 of FIG. 20.
Figure 22:
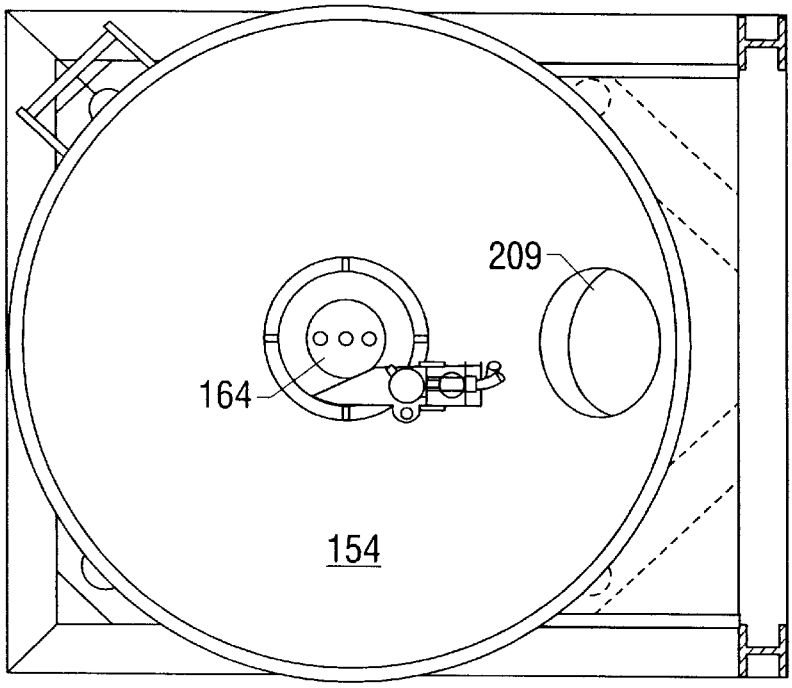
FIG. 22 is a sectional view taken along lines 22—22 of FIG. 20.

Arrow 67 in FIG. 16 indicates the discharge of air from ballast tanks 53, 54 using control valve 55 when the underwater tank assembly 51 is to be lowered to the sea bed 76. In FIG. 19, arrows 68 indicate the discharge of water from tanks 53, 54 when the underwater tank assembly is to be elevated. Outlet fittings 69, 70 enable water to be discharged from ballast tanks 53, 54.

Support frame 55 can be in the form of a truss or a plurality of feet for engaging the sea bed 76 when the underwater tank assembly 51 is lowered to the sea bed prior to be being filled with drill cuttings during use.

When main tank 52 has been filled with well drill cuttings and the tank assembly 51 has been raised to the water surface 13, the tank assembly 51 can be towed to a disposal sight using tow line 72, tug boat 73 and tow eyelet 71 on tank 52.

It should be understood that the underwater tank assembly 51 can be used to supplement tanks 23, 23A–23E as described in the preferred embodiment of FIGS. 1–6. Alternatively, the underwater tank assembly 51 can be used for storage instead of the boat mounted tanks 23, 23A–23E.

Figure 23:
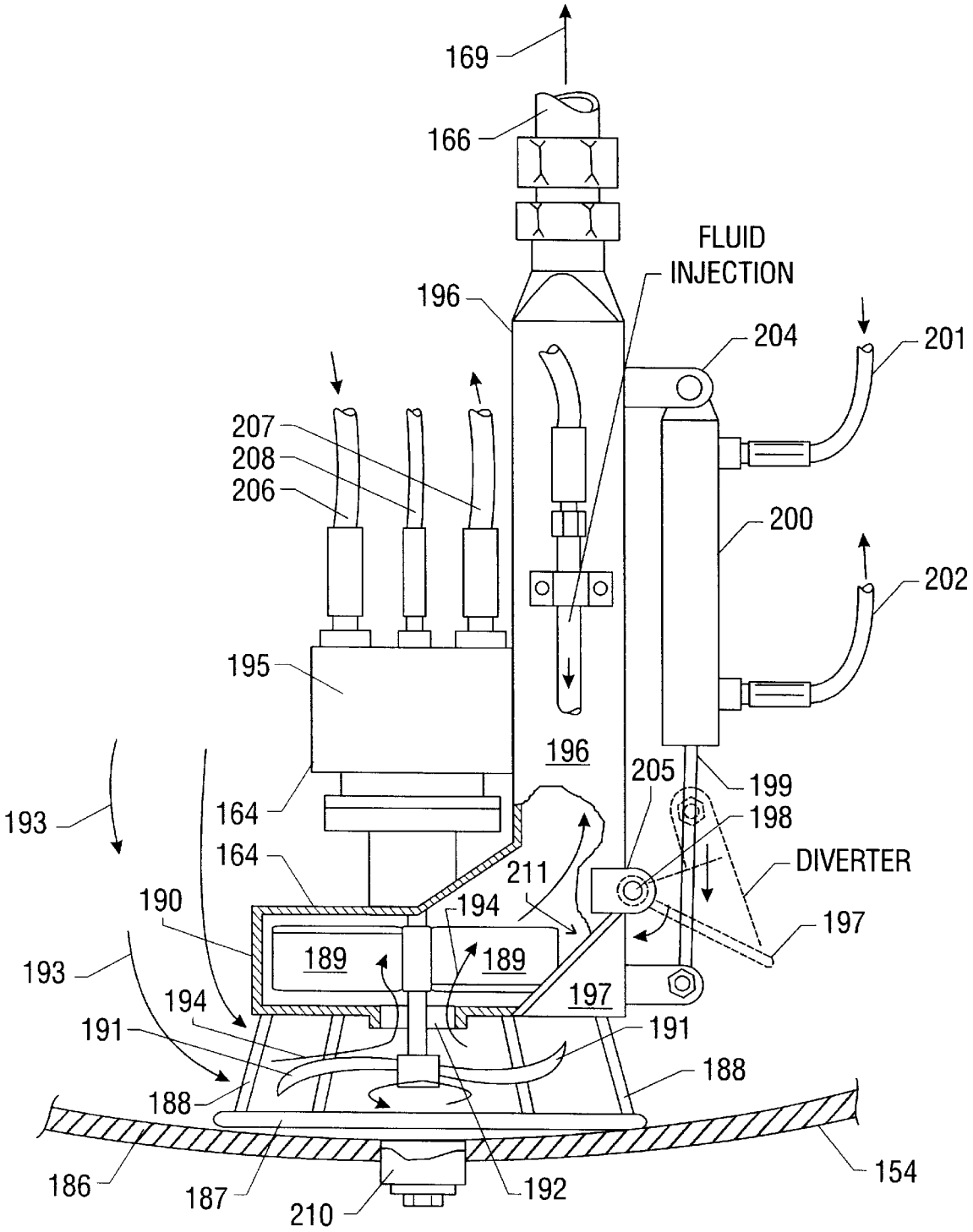
FIG. 23 is a fragmentary elevational view of the processing tank portion of the second embodiment of the apparatus of the present invention.
Figure 24:
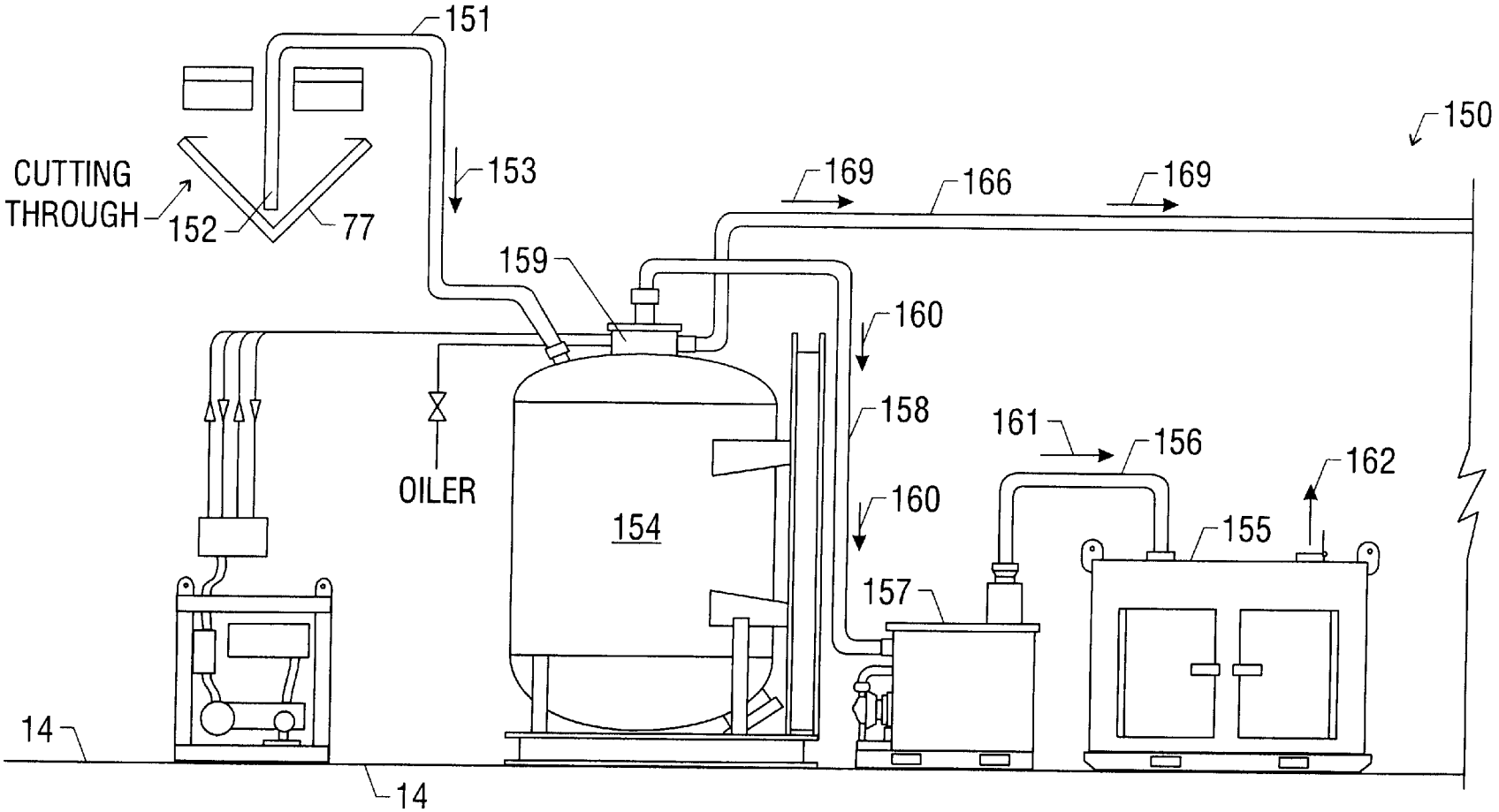
FIG. 24 is a schematic elevational view of the second embodiment of the apparatus of the present invention.
Figure 25:
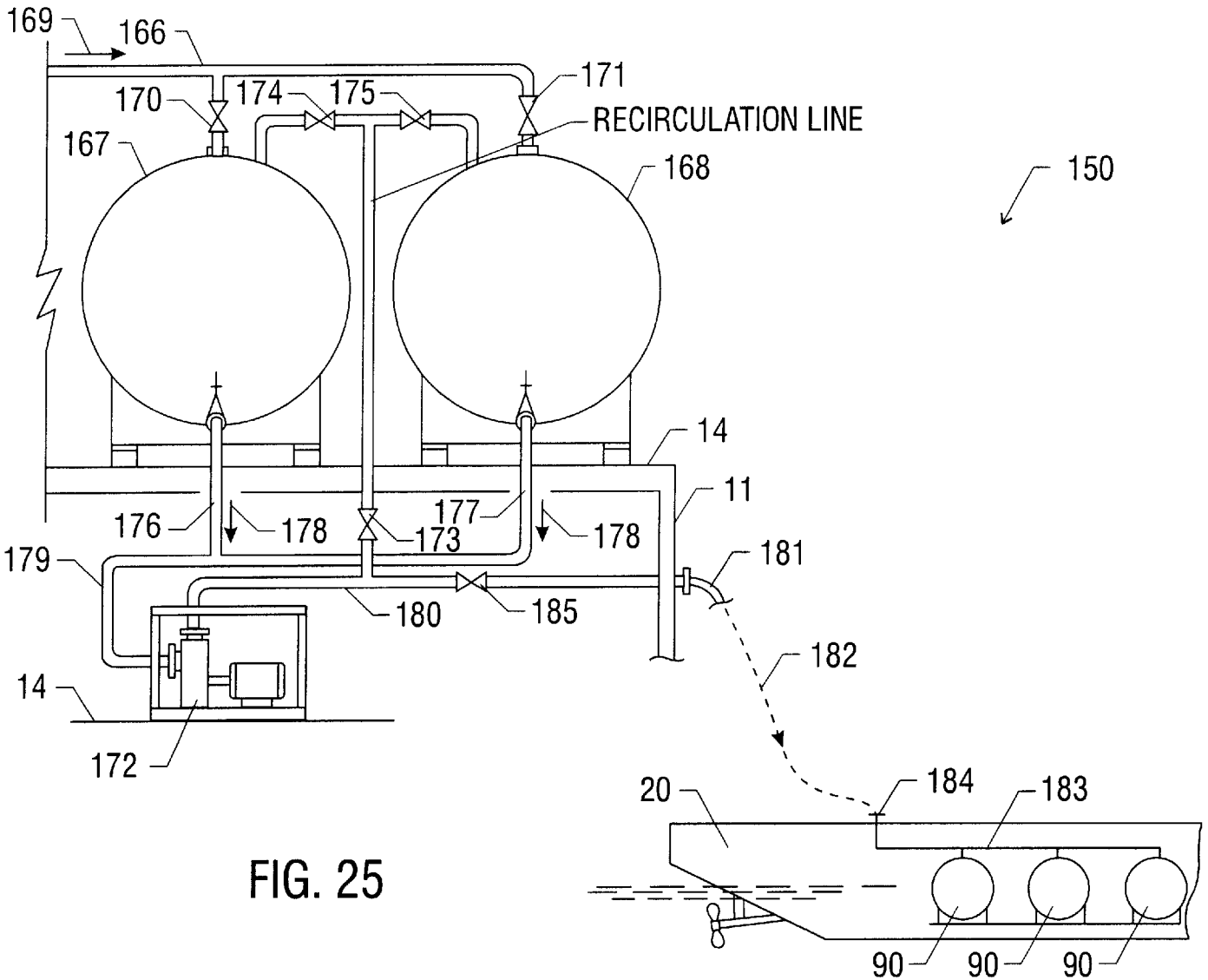
FIG. 25 is a schematic view of the second embodiment of the apparatus of the present invention.
Figure 26:
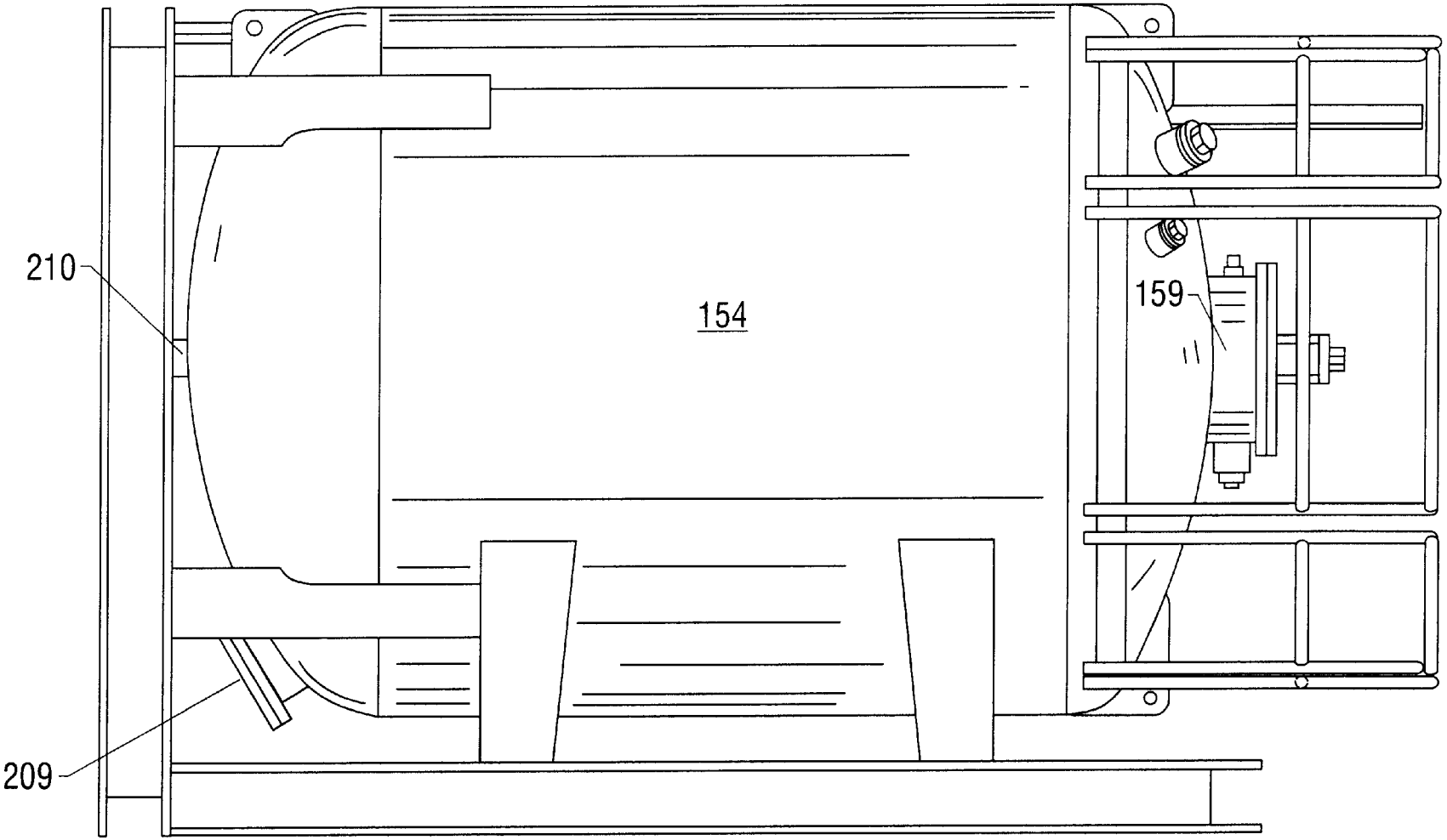
FIG. 26 is a side elevational view of the processing tank portion of the second embodiment of the apparatus of the present invention.

FIGS. 20–26 show a second embodiment of the apparatus of the present invention designated generally by the numeral 150. In FIGS. 24 and 25, the second embodiment of the apparatus of the present invention includes a number of components that are placed on an oil and gas well drilling platform or tower 11 as with the embodiment of FIGS. 1–19. In the embodiment of FIGS. 21–26, the various components as shown in FIGS. 24 and 25 can be placed on a deck of platform 11 such as lower deck 14, upper deck 15, or intermediate deck 16, as the lower deck 14 in FIGS. 24 and 25.

As with the embodiment of FIGS. 1–19, drill cuttings that are collected from a cuttings trough 77 on platform 11 are transferred to storage tanks 190 on a work boat 20.

In FIGS. 24–25, a suction line 151 has an intake end portion 152 that communicates with trough 77. The cuttings 152 are transferred in the direction of arrow 153 to processing tank 154 (see FIGS. 20–23 and 26). A vacuum unit 155 draws a vacuum on the tank 154. A suction line 156 communicates with drop tank 157. An additional suction line 158 extends between drop tank 157 and manway 159 at the upper end portion of tank 154.

Arrows 160 in FIG. 24 indicate the flow path of air in line 158 when a vacuum is being drawn on tank 154. Similarly, arrow 161 in FIG. 24 indicates the flow of air from drop tank 157 to vacuum unit 155. Arrow 162 shows the discharge of air from the vacuum unit. Vacuum unit 155, drop tank 157, and processing tank 154 can each be skid mounted for ease of transport to the platform or tower 11 and upon the deck 14 of the platform or tower 11. Hydraulic control unit 163 can used to control the hydraulic functions of pump apparatus 164 using control lines 201, 202, 206–208. Pump 164 is contained with the interior 165 of processing tank 154 (see FIGS. 20–23).

The details of construction of pump 164 can be seen in FIGS. 20–23. The pump 164 is placed at the lower end of tank 154. It: can be placed against the lower end of the tank wall 186 as shown in FIG. 23. Pump 164 is mounted upon a base that can include ring 187 and a plurality of legs 188. The plurality of legs 188 support housing 190. Impeller 189 is placed within housing 190. The housing 190 has a lower inlet opening 192 through which fluid can travel during recirculation of cuttings and fluid. A plurality of pulverizing/cutting blades 191 can be mounted on a shaft that is common with pump impeller 189 and driven by motor 195 as shown in FIG. 23. In this fashion, cuttings that have been blended with a liquid waste stream (eg. washwater, rainwater, etc.) and urrified or liquified flow downwardly within the interior 165 of tank 154 as shown by arrows 193 in FIG. 23. Arrows 194 indicate the travel of blended, slurrified, or liquified cuttings into housing 190 through opening 192. Impeller 189 and blades 191 are powered with rotary hydraulic motor 195. Motor 195 is provided with hydraulic flow lines 206, 207 that communicate with a suitable hydraulic control unit 163. Motor 195 can be lubricated using lubrication flow line 208. Motor 195, housing 190, impeller 189 and hydraulic control unit 163 can be obtained commercially from Alco Pump Company of Beaumont, Tex.

A discharge header 196 receives blended and slurrified material that is discharged from pump housing 190. A diverter valve member 197 can be used to open or close side discharge 211 of header 196. When the diverter valve member 197 is in a closed position as shown in hard lines in FIG. 23, blended, slurrified cuttings or liquified cuttings enter header 196 and flow out of tank 154 through discharge flow line 166 in the direction of arrow 169.

Prior to the present invention, liquid waste streams were typically collected on oil and gas well drilling platforms as a liquid only waste stream. This would include rain water and wash down, for example. Such liquid wastes were typically pumped to a boat. Cuttings have heretofore been primarily disposed of by either injection into a downhole disposal well as discussed in U.S. Pat. No. 5,129,469 or transmitted to a box for later disposal on shore such as shown and described in the Dietzen U.S. Pat. No. 4,878,576. With the present invention, the liquid waste stream (for example rain water and wash water) can be combined with the drill cuttings and blended for disposal by transfer to a boat. When diverter valve member 197 is opened to the position shown in phantom lines in FIG. 23, material contained within tank 154 is continuously recirculated so that the drill cuttings can be blended and homogenized and slurrified. Wash water and other liquid waste can be added to the cuttings by transmitting those cuttings to the processing tank 154. By combining the liquid waste stream that necessarily must be disposed of (for example wash water, rain water, contaminated mud, waste drilling fluid or other liquids, etc.) with the drill cuttings and blending and homogenizing that mix, a pumpable slurry can be obtained. Fluid injection line 203 can be used to add fluid (for example liquid waste streams) to the material contained within tank 154 in order to change the consistency of the slurry to obtain a desired pumpable slurry. In this fashion, separate waste streams that contain some components that can be pumped can be combined with waste streams that cannot be pumped (for example drill cuttings) to provide a homogenized, pumpable waste stream.

Diverter valve member 197 can be pivotally mounted to manifold 196 at pivot 198. Push rod 199 moves upwardly and downwardly in order to open or close the diverter valve member 197. Push rod 199 is reciprocally moved by hydraulic cylinder 200 that is controlled by a pair of hydraulic fluid flow lines 201, 202. Hydraulic cylinder 200 can be mounted to manifold 196 at supports 204, 205. The attachment 205 can function as the pivotal connection 198 between diverter valve member 198 and header 196. In this fashion, one end of push rod 199 pivotally attaches to diverter valve member 197 in order to support one end of the assembly of hydraulic cylinder 200 and pushrod 199.

Tank 154 can be provided with clean outs such as larger diameter clean out opening 209 and smaller diameter clean out opening 210 which can be in the nature of a drain fitting positioned at the very bottom of tank wall 186 as shown in FIG. 23.

In FIGS. 24, 25, discharge flow line 166 extends from processing tank 154 to a pair of holding tanks 167, 168. Slurrified, blended, or liquified drill cuttings can be discharged from processing tank 154 to holding tanks 167, 168 in the direction of arrow 169 in FIG. 24 and 25. Valves 170, 171 control the flow of liquified, blended or slurrified drill cuttings into either tank 167 or 168 as selected. It should be understood that any number of holding tanks 167, 168 could be provided on deck 14 of platform Pump 172 can be provided on platform 11 for recirculating material within tank 167, 168 to prevent settling. Pump 172 can also be used as a discharge pump to pump material contained in, tanks 167 or 168 to boat 20. When recirculating material within tanks 167, 168, valve 173 is opened as are valves 174 and 175. The pump 172 can intake material from tanks 167 and 168 through flow lines 176, 177 flowing in the direction of arrows 178. Flow line 179 communicates with flow lines 176 and 177 to intake material at the suction side of pump 172. Valve 185 is opened and valve 173 is closed when material is to be discharged from tanks 167, 168 via. flow line 180.

Discharge flow line 180 can be provided with a quick connect quick disconnect fitting 181 for communicating with hose 182 that can be connected to header 183 on boat 20 at fitting 184. The boat 20 can be a large work boat (eg. 70–180' in length) and contain a number of storage tanks 190 that each receive material from header 183. The boat 20 is preferably sized to contain a large number of tanks 190 so that a huge volume of processed drill cuttings can be disposed of by transferring blended drill cuttings material and liquid waste to the boat 20.

The following table lists the parts numbers and parts descriptions as used herein and in the drawings attached hereto.

PARTS LIST

| Part Number | Description |
|---|---|
| 10 | cuttings disposal apparatus |
| 11 | platform |
| 12 | jacket |
| 13 | water surface |
| 14 | lower deck |
| 15 | upper deck |
| 16 | intermediate deck |
| 17 | crane |
| 18 | boom |
| 19 | lifting line |
| 20 | work boat |
| 21 | aft deck |
| 22 | vacuum unit |
| 23 | storage tank |
| 23A | storage tank |
| 23B | storage tank |
| 23C | storage tank |
| 23D | storage tank |
| 23E | storage tank |
| 24 | first suction line |
| 25 | second suction line |
| 26 | rig vacuum tank |
| 27 | rig vacuum tank |
| 28 | rig vacuum tank |
| 29 | rig vacuum tank |
| 30 | vacuum unit |
| 31 | discharge manifold |
| 32 | discharge line |
| 33 | outlet valve |
| 34 | suction manifold |
| 35 | suction line |
| 36 | valve |
| 37 | manifold |
| 38 | suction intake |
| 39 | arrow |
| 40 | interior |
| 41 | wall |
| 42 | end |
| 43 | end |
| 44 | auger |
| 45 | supply header |
| 46 | motor drive |
| 47 | valve |
| 48 | valve |
| 49 | walkway |
| 50 | header |
| 51 | underwater tank assembly |
| 52 | main tank |
| 53 | ballast tank |
| 54 | ballast tank |
| 55 | support frame |
| 56 | vacuum fitting |
| 57 | vacuum line |
| 58 | arrow |
| 59 | inlet fitting |
| 60 | cuttings flow line |
| 61 | arrow |
| 62 | ballast piping |
| 63 | ballast fitting |
| 64 | ballast fitting |
| 65 | control valve |
| 66 | arrow |
| 67 | arrow |
| 68 | arrow |
| 69 | outlet |
| 70 | outlet |
| 71 | towing eyelet |
| 72 | tow line |
| 73 | tugboat |
| 74 | connecting plate |
| 75 | arrow |
| 76 | seabed |
| 77 | trough |
| 78 | suction line |

-continued

PARTS LIST

| Part Number | Description |
|---|---|
| 79 | screen |
| 80 | sleeve |
| 90 | pump |
| 91 | arrow |
| 92 | plate |
| 93 | plate |
| 94 | recess |
| 95 | recess |
| 96 | fitting |
| 97 | pin |
| 98 | pin |
| 99A | coupling member |
| 99B | coupling member |
| 100 | deck |
| 101 | tank |
| 102 | hold |
| 103 | tank |
| 104 | header |
| 105 | header |
| 106 | walkway |
| 107 | ladder |
| 108 | cuttings grinder unit |
| 109 | flow line |
| 110 | header |
| 111 | pump |
| 112 | flow line |
| 113 | shaker |
| 114 | holding tank |
| 115 | collection box |
| 116 | pump |
| 117 | header |
| 118 | pump |
| 119 | header |
| 120 | flow line |
| 121 | auger |
| 122 | screw conveyor |
| 123 | separator |
| 124 | flow line |
| 125 | tank |
| 126 | cuttings dryer unit |
| 127 | conveyor |
| 128 | pump |
| 129 | flow line |
| 130 | discharge pipe |
| 131 | flow line |
| 150 | cuttings disposal apparatus |
| 151 | suction line |
| 152 | intake |
| 153 | arrow |
| 154 | processing tank |
| 155 | vacuum unit |
| 156 | suction line |
| 157 | drop tank |
| 158 | suction line |
| 159 | manway |
| 160 | arrow |
| 161 | arrow |
| 162 | arrow |
| 163 | hydraulic control unit |
| 164 | pump |
| 165 | tank interior |
| 166 | discharge flow line |
| 167 | holding tank |
| 168 | holding tank |
| 169 | arrow |
| 170 | valve |
| 171 | valve |
| 172 | pump |
| 173 | pump |
| 174 | pump |
| 175 | pump |
| 176 | flow line |
| 177 | flow line |
| 178 | arrow |
| 179 | flow line |

-continued

PARTS LIST

| Part Number | Description |
|---|---|
| 180 | flow line |
| 181 | fitting |
| 182 | hose |
| 183 | header |
| 184 | fitting |
| 185 | valve |
| 186 | tank wall |
| 187 | base ring |
| 188 | leg |
| 189 | impeller |
| 190 | housing |
| 191 | cutting blade |
| 192 | inlet opening |
| 193 | arrow |
| 194 | arrow |
| 195 | motor |
| 196 | discharge header |
| 197 | diverter valve member |
| 198 | pivot |
| 199 | push rod |
| 200 | hydraulic cylinder |
| 201 | hydraulic fluid flow line |
| 202 | hydraulic fluid flow line |
| 203 | fluid injection line |
| 204 | support |
| 205 | support |
| 206 | hydraulic fluid flow line |
| 207 | hydraulic fluid flow line |
| 208 | lubrication flow line |
| 209 | clean out |
| 210 | drain fitting |
| 211 | side discharge |
| V | valve |

The foregoing embodiments are presented by way of example only; the scope of the present invention is to be limited only by the following claims.

What is claimed is:

1. A method for disposing of drill cuttings from an oil and/or gas well drilling platform, comprising:

a) transporting said drill cuttings to a cuttings collection area on the platform;

b) transporting said drill cuttings from said cuttings collection area to a processing tank;

c) adding liquid to the cuttings in the processing tank;

d) blending the cuttings and the liquid in the processing tank; and e) transferring the blended drill cuttings from the processing tank to a work boat via a flow line.

2. A method as claimed in claim 1, wherein said drill cuttings are transported directly to said processing tank via a first suction line.

3. A method as claimed in claim 2, wherein a vacuum is generated within the processing tank so that said drill cuttings are transported from said cuttings collection area to said tank via said first suction line.

4. A method as claimed in claim 3, wherein the vacuum generated is in the range of about 16 to 29 inches of mercury.

5. A method as claimed in claim 2, wherein a vacuum is generated within said processing tank so that said drill cuttings are transported from said cuttings collection area to said processing tank via said first suction line and cuttings are emptied from said processing tank using a pump.

6. A method as claimed in claim 2, wherein the flow velocity in the first suction line is in the range of about 100 to 600 feet per second.

7. A method as claimed in claim 1, wherein a vacuum is generated by vacuum-generating means that is in fluid communication with the processing tank via a second suction line.

8. A method as claimed in claim 7, wherein liquid waste and solid waste are removed from the second suction line at a separator that is positioned in fluid communication with the second suction line upstream of the vacuum-generating means.

9. A method as claimed in claim 7, wherein the vacuum-generating means generates a fluid flow in the first and second suction lines in the range of about 300 to 3200 cubic feet per minute.

10. A method as claimed in claim 1, wherein said tank has a recirculating pump therein.

11. A method as claimed in claim 1 wherein the liquid is a waste stream.

12. A method as claimed in claim 1, wherein liquid waste and solid waste are removed before transfer to said work boat.

13. A method as claimed in claim 1, wherein said drill cuttings are transported to said work boat at least in part through gravity flow.

14. A method as claimed in claim 1, wherein said drilling fluid is recycled for further use.

15. Apparatus for use in disposing of drill cuttings from an oil and/or gas well drilling marine platform, comprising:

a) a processing tank to which said drill cuttings are transported;

b) a blending device that can break up drill cuttings to reduce their size said blending device being positioned in a flow path that communicates with the tank;

c) a work boat floating next to the platform; and d) a flow line for transferring cuttings from the processing tank to the work boat.

16. Apparatus as claimed in claim 15, further comprising vacuum-generating means for generating a vacuum within the processing tank so that said drill cuttings are transported to said processing tank via a first suction line.

17. Apparatus as claimed in claim 16, wherein said vacuum-generating means is in fluid communication with the processing tank via a second suction line.

18. Apparatus as claimed in claim 17, further comprising a separator that is positioned in fluid communication with the second suction line upstream of the vacuum-generating means for removing liquids and solids from the second suction line.

19. Apparatus as claimed in claim 16, wherein the processing tank includes a pump therein, said first suction line transporting said drill cuttings to said processing tank and said pump discharging said drill cuttings from said processing tank.

20. A method for removing drill cuttings from an oil and gas well drilling platform that uses a drill bit supported with a drill string and a well drilling fluid during a digging of a well bore, comprising:

a) transmitting the drill cuttings to a cuttings receptacle on the platform;

b) auctioning the drill cuttings with a first suction line having an intake end portion that is positioned at the receptacle;

c) transmitting the drill cuttings via the first suction line to a processing tank that has at least one access opening for communicating with a tank interior;

d) forming a vacuum within the processing tank interior with a blower that is in fluid communication with the processing tank interior via a second suction line;

e) transferring the cuttings from the processing tank to a holding tank using a flow line; and f) transferring the cuttings from the holding tank to a boat using a flow line.

21. The method of claim 20 wherein there are a plurality of holding tanks on the platform.

22. The method of claim 21 further comprising the step of connecting the holding tanks with a manifold.

23. The method of claim 20 wherein the flow velocity in the suction line is about 100–600 feet per second.

24. The method of claim 20 wherein in step "f" the cuttings are pumped from the holding tank.

25. The method of claim 20 wherein liquids and solids are separated from the second suction line.

26. The method of claim 20 wherein in step "e", a blower generates fluid flow in the flow line of between about 300 and 3200 cubic feet per minute.

27. The method of claim 20 wherein the vacuum formed within the processing tank is between about 16 and 29 inches of mercury.

28. A method of removing drilling cuttings from an oil and gas well drilling platform that uses a drill bit supported with a drill string and a well drilling fluid during a digging of a well bore, comprising:

a) separating drill cuttings from at least a volume of the well drilling fluid on the drilling platform so that a volume of the drilling fluids can be recycled into the well bore during drilling operations;

b) transmitting the cuttings to a collection area on the platform;

c) suctioning the separated drill cuttings with a first suction line having an intake end portion;

d) transmitting the drill cuttings via the first suction line to a processing tank that has at least one opening for communicating with the processing tank interior;

e) forming a vacuum within the processing tank interior with a blower that is in fluid communications with the processing tank interior via a second vacuum line;

f) connecting the processing tank to a floating work boat with a discharge flow line;

and g) transmitting cuttings from the processing tank to the work boat via the flow line.

29. The method of claim 28 further comprising transferring the cuttings from the processing tank to a holding tank.

30. A method for disposing of drill cuttings from an oil and/or gas well drilling platform, comprising:

a) transporting said drill cuttings to a materials collection receptacle;

b) transporting said drill cuttings from said receptacle [via a first suction line] to a processing tank using a vacuum;

c) blending the drill cuttings and a liquid in a flow path that communicates with the processing tank; and d) transferring the drill cuttings and liquid from the processing tank to a work boat via a flow line.

31. A method as claimed in claim 30, wherein said drill cuttings are transported directly to said processing tank via a first suction line.

32. A method as claimed in claim 31, wherein said drill cuttings are transported via said first suction line from the bottom of said cuttings receptacle.

33. A method as claimed in claim 30, wherein a vacuum is generated within the processing tank so that said drill cuttings are transported from said cuttings receptacle to said tank via said first suction line.

34. A method as claimed in claim 30, wherein said vacuum is generated by vacuum generating means that is in fluid communication with the processing tank via a second suction line.

35. A method as claimed in claim 30, wherein said processing tank has a pump therein.

36. A method as claimed in claim 35, wherein the vacuum is generated within said processing tank so that said drill cuttings are transported from said cuttings receptacle to said processing tank via said first suction line and cuttings are emptied from said processing tank using said pump.

37. A method as claimed in claim 36, wherein said vacuum is generated by a vacuum-generating means that is in fluid communication with the processing tank via a second suction line.

38. A method as claimed in claim 37, wherein liquid waste and solid waste are removed from the second suction line at a separator that is positioned in fluid communication with the second suction line upstream of the vacuum-generating means.

39. A method as claimed in claim 37, wherein the vacuum-generating means generates a fluid flow in the first and second suction lines in the range of about 8.5 to 42.5 $m^3$ (300 to 1500 cubic feet) per minute.

40. A method as claimed in claim 30, wherein the vacuum generated is in the range of about 16 to 29 inches of mercury.

41. A method as claimed in claim 30, wherein said drill cuttings are transported to said tank in part through gravity flow.

42. A method for disposing of drill cuttings from an oil and/or gas well drilling platform, comprising:

a) separating said drill cuttings from substantially all of a well drilling fluid in which said drill cuttings have been conveyed from an area being drilled;

b) transporting said drill cuttings to a materials collection receptacle;

c) transporting said drill cuttings from said receptacle via a first suction line to a processing tank using a vacuum;

d) blending the cuttings and a liquid inside the processing tank; and e) transferring the cuttings to a work boat via a flow line.

43. The method of claim 42, wherein the transportation of drill cuttings to the processing tank occurs substantially continuously over time as a well is drilled.

44. Apparatus for use in disposing of drill cuttings from an oil and/or gas well drilling platform, comprising:

a) means for separating said drill cuttings from substantially all of a well drilling fluid in which said drill cuttings are carried from the area being drilled;

b) a materials collection receptacle to which said drill cuttings are transported;

c) a processing tank for receiving said drill cuttings;

d) a suction line for transporting said drill cuttings from said collection receptacle to said processing tank via a vacuum; and e) a chopping device that enables cuttings particle size to be reduced inside the processing tank.

45. The apparatus of claim 44, wherein the transportation of drill cuttings to the processing tank occurs substantially continuously over time as a well is drilled.

* * * * *